US009009995B2

(12) United States Patent
Freund et al.

(10) Patent No.: US 9,009,995 B2
(45) Date of Patent: Apr. 21, 2015

(54) WEAR ASSEMBLY

(75) Inventors: Daniel Freund, Gailes (AU); Mark Hurley, Mount Gravatt (AU); David Hoad, Westend (AU); Matthew Reushle, Forest Lake (AU)

(73) Assignee: Bradken Resources Pty Limited, Mayfield West (AU)

( * ) Notice: Subject to any disclaimer, the term of this patent is extended or adjusted under 35 U.S.C. 154(b) by 221 days.

(21) Appl. No.: 13/695,429

(22) PCT Filed: Apr. 29, 2011

(86) PCT No.: PCT/AU2011/000487

§ 371 (c)(1),
(2), (4) Date: Feb. 13, 2013

(87) PCT Pub. No.: WO2011/134014

PCT Pub. Date: Nov. 3, 2011

(65) Prior Publication Data

US 2013/0139416 A1 Jun. 6, 2013

(30) Foreign Application Priority Data

Apr. 30, 2010 (AU) ..... 2010901834

(51) Int. Cl.
*E02F 9/28* (2006.01)

(52) U.S. Cl.
CPC ..... *E02F 9/2883* (2013.01); *E02F 9/2825* (2013.01); *E02F 9/2841* (2013.01)

(58) Field of Classification Search
USPC ..... 37/446, 450–460; 172/701.1–701.3; 403/150, 153, 297, 355; 299/109–113
See application file for complete search history.

(56) References Cited

U.S. PATENT DOCUMENTS

| | | | | | |
|---|---|---|---|---|---|
| 4,919,566 | A * | 4/1990 | Caron et al. | ..... | 404/121 |
| 5,765,301 | A * | 6/1998 | Clendenning | ..... | 37/457 |
| 5,937,550 | A * | 8/1999 | Emrich | ..... | 37/458 |
| 5,987,787 | A * | 11/1999 | Mack | ..... | 37/456 |
| 6,976,325 | B2 * | 12/2005 | Robinson et al. | ..... | 37/456 |
| 7,681,341 | B2 | 3/2010 | Ruvang | | |

FOREIGN PATENT DOCUMENTS

| | | |
|---|---|---|
| CA | 2 598 209 | 6/2003 |
| WO | WO-2008/119102 | 10/2008 |

OTHER PUBLICATIONS

International Search Report mailed Jul. 29, 2011, directed to International Application No. PCT/AU2011/000487; 4 pages.
International Preliminary Report on Patentability mailed Aug. 28, 2012, directed to International Application No. PCT/AU2011/000487; 8 pages.

* cited by examiner

*Primary Examiner* — Robert Pezzuto
(74) *Attorney, Agent, or Firm* — Morrison & Foerster LLP

(57) ABSTRACT

A wear assembly for attachment to a digging device, the wear assembly comprising: a wear member arranged to be assembled with the digging device in an assembled condition; and a lock mounted to the digging device, the lock adjustable between an extended configuration and a retracted configuration, the lock comprising at least one locking element that projects outwardly from its mounting in the extended configuration of the lock and is operative to be displaced inwardly from the extended configuration towards its mounting to adopt the retracted configuration of the lock; wherein, with the wear member in the assembled condition with the digging device, movement of the at least one locking element from the extended configuration towards the retracted configuration causes the wear member to be locked to the digging device in the assembled condition.

25 Claims, 20 Drawing Sheets

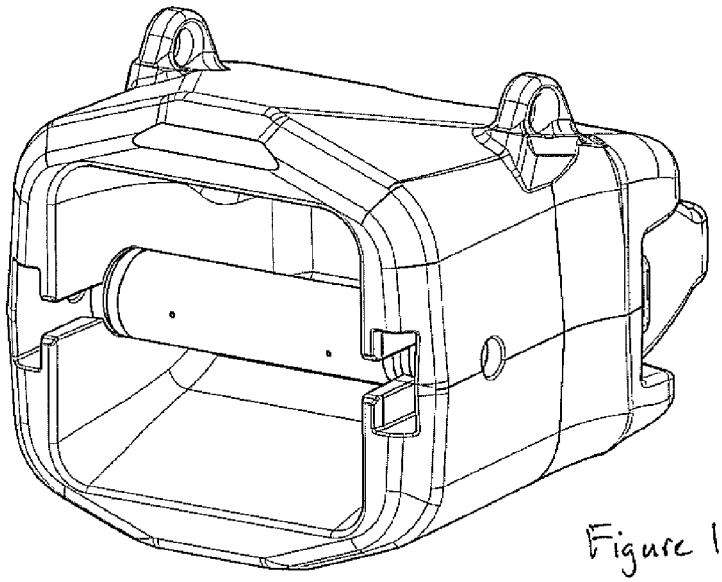
Figure 11
Figure 12
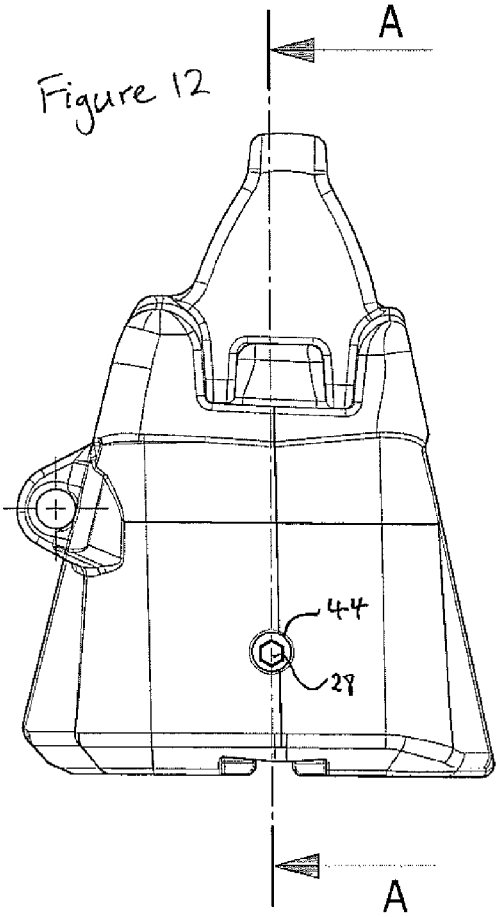
Figure 13
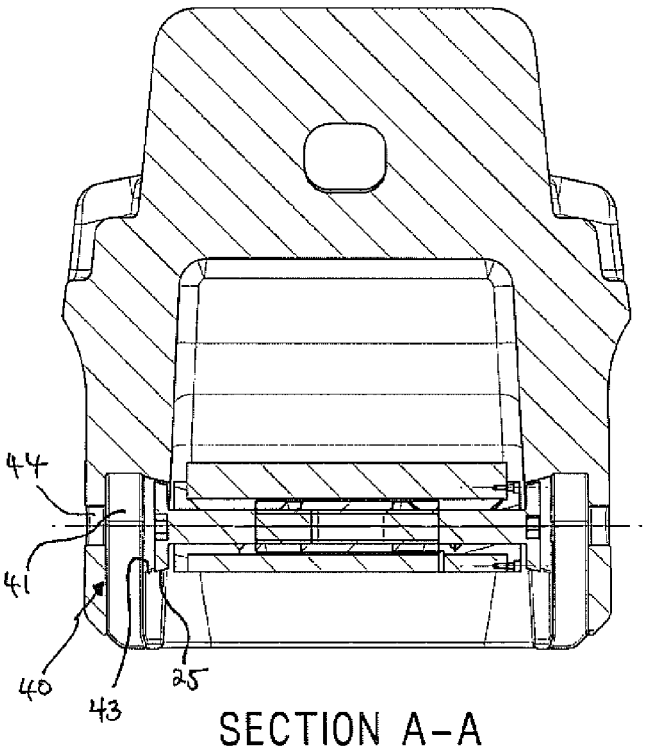

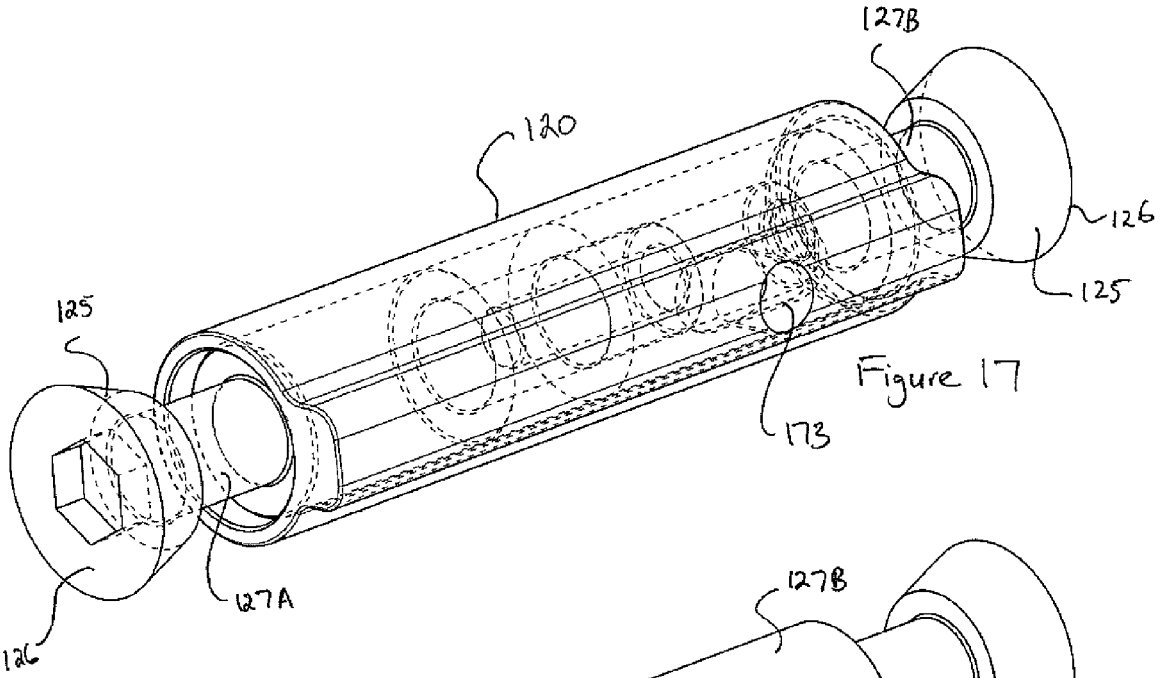
Figure 17
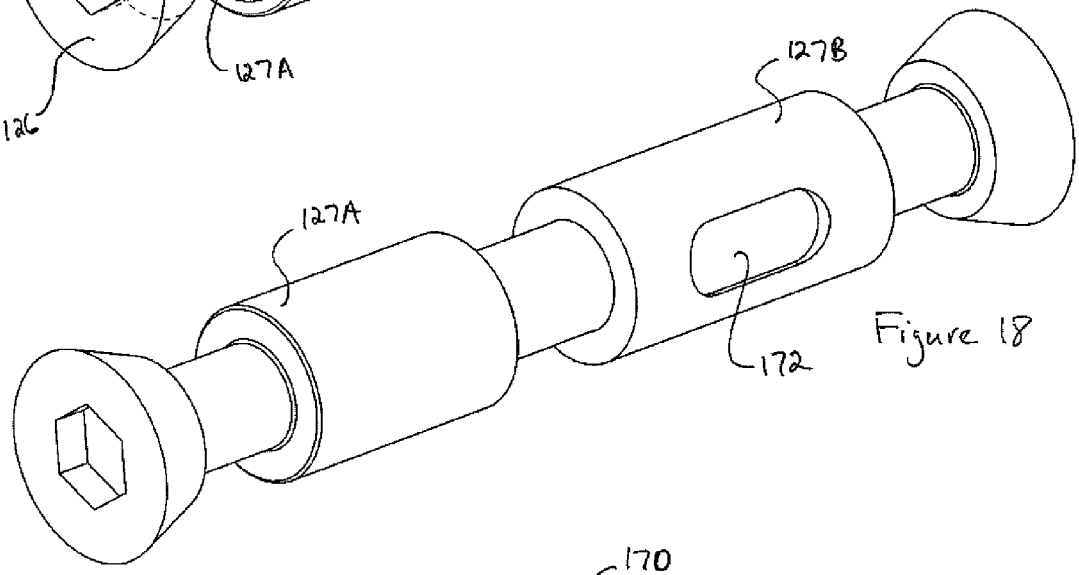
Figure 18
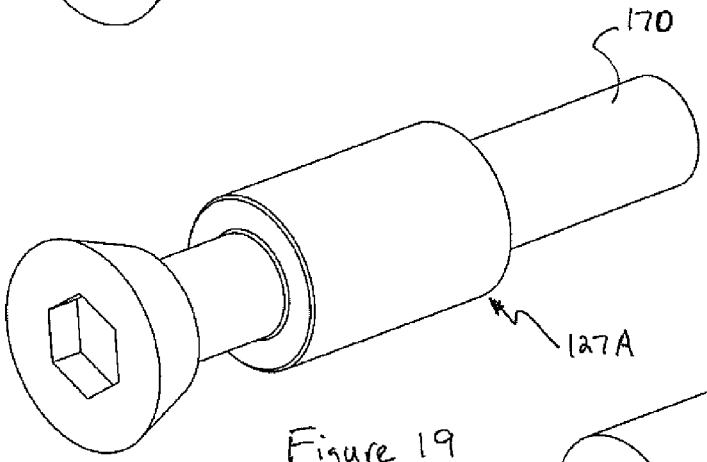
Figure 19
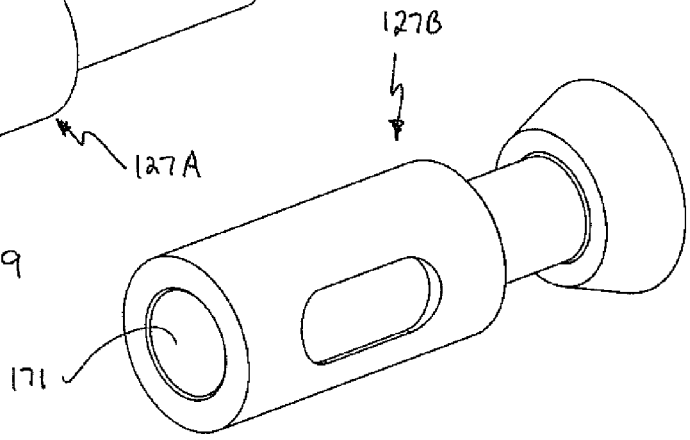

SECTION A–A

SECTION A–A (A)

(B)

(C)

SECTION C-C

WEAR ASSEMBLY

CROSS-REFERENCE TO RELATED APPLICATIONS

This application is a National Phase application under 35 U.S.C. §371 of International Application No. PCT/AU2011/000487 filed Apr. 29, 2011 and claims priority benefit of Australian Patent Application No. 2010901834 filed Apr. 30, 2010.

FIELD OF THE DISCLOSURE

The present disclosure relates to wear assemblies for attachment to digging devices including shrouds for protecting the lip edges of digging devices and excavation teeth for attachment to digging devices. The present disclosure also relates to components of wear assemblies. The disclosure has application for land based digging devices and is herein described in that context. However, it is to be appreciated that the disclosure has broader application for example in waterborne digging devices such as dredgers, and is therefore not limited to that application.

BACKGROUND

Excavation teeth are provided on the digging edge of various digging devices such as the buckets of front end loaders. Each excavation tooth is formed of a number of parts, commonly a point, an adapter and a lock. The adapter is typically fitted to the digging device and the point fits over the adapter and is retained in place by the lock. In some instances one or more intermediate parts may be also included between the point and the adapter.

The reason that the excavation tooth is formed of a number of parts is to avoid having to discard the entire tooth when only parts of the tooth, in particular the ground engaging part of the tooth (i.e. the point) is worn or broken.

On some types of digging devices, shrouds are also attached to the digging lip of the device to protect the digging lip edge from wear. Once worn, the shrouds can be removed and discarded and a new replacement shroud attached. This reduces the need to replace the whole device if the lip edge became worn, which would be much more costly than replacing just the shrouds. The shrouds typically comprise a wear member that fits around a portion of the lip edge and a mechanical locking device for locking the wear member to the lip, but which also allows the wear member to be removed once worn. The shrouds may be disposed along the entire length of the lip edge or be disposed between excavation teeth that are attached to the lip.

Various types of shrouds and excavation teeth and their component parts are known. However, it is always desirable to design new shrouds, excavation teeth and parts thereof. Throughout this specification, the term "wear assembly" is intended to include shrouds and excavation teeth and "wear members" may include members that form part of shrouds or excavation teeth.

SUMMARY OF THE DISCLOSURE

According to an aspect of the present disclosure, there is provided a wear assembly for attachment to a digging device, the wear assembly comprising:

a wear member arranged to be assembled with the digging device in an assembled condition; and a lock mounted to the digging device, the lock adjustable between an extended configuration and a retracted configuration, the lock comprising at least one locking element that projects outwardly from its mounting in the extended configuration of the lock and is operative to be displaced inwardly from the extended configuration towards its mounting to adopt the retracted configuration of the lock; wherein, with the wear member in the assembled condition with the digging device, movement of the at least one locking element from the extended configuration towards the retracted configuration causes the wear member to be locked to the digging device in the assembled condition.

The lock may be mounted to a portion of the digging device itself or mounted to the digging device via a further wear member that is disposed on the digging device.

According to another aspect of the present disclosure, there is provided a wear assembly comprising:

a first wear member including a socket;

a second wear member including a nose portion, the wear members arranged in an assembled condition where the nose portion of the second wear member is received within the socket of the first wear member; and a lock mounted to the second wear member, the lock adjustable between an extended configuration and a retracted configuration, the lock comprising at least one locking element that projects outwardly from the second wear member in the extended configuration of the lock and is operative to be displaced inwardly from the extended configuration towards the second wear member to adopt the retracted configuration of the lock; wherein, with the first and second wear members in the assembled condition, movement of the at least one locking element from the extended configuration towards the retracted configuration causes the second wear member to be locked to the first wear member in the assembled condition.

The first wear member may have an inner surface that defines said socket, and at least one slot that extends along said inner surface and configured to provide clearance for the at least one locking element to allow the second wear member to move relative to the first wear member into the assembled condition whilst the lock is in its extended configuration.

The first wear member may have an engaging surface which defines a portion of the at least one slot, the engaging surface being arranged to oppose the at least one locking element when in the assembled condition, and the at least one locking element is caused to move into engagement with the engaging surface on movement of the locking element towards the retracted configuration to lock the first wear member to the second wear member.

The lock may further comprise a lock body and the at least one locking element may be movably mounted to said lock body.

The second wear member may include a cavity in which the lock body resides.

The lock body may comprise a ridge which is configured to be received in a groove of the second wear member cavity.

According to another aspect of the disclosure, there is provided a wear member assembly comprising:

a body; and a lock mounted to the body, the lock adjustable between an extended unlocking configuration and a retracted locking configuration, wherein the lock comprises at least one locking element that projects outwardly from the body in the extended configuration of the lock and is operative to be displaced inwardly from the extended unlocking configuration towards the body to adopt the retracted locking configuration of the lock.

According to a further aspect of disclosure, there is provided a lock for locking a wear member in an assembled condition with another member, wherein the lock comprises:

a body; and at least one locking element that projects outwardly from the body in the extended configuration of the lock and is operative to be displaced inwardly from the extended configuration towards the body to adopt the retracted configuration of the lock, wherein movement of the at least one locking element from the extended configuration towards the retracted configuration is arranged to cause the wear member to be locked in its assembled condition.

The another member may be a portion of a digging device or a further wear member for example.

Each locking element may comprise at least one, preferably two engaging surfaces for engaging the wear member in its assembled condition with another member.

Each engaging surface may be angled with respect to the other engaging surface of that locking element, preferably at an obtuse angle. In use, the angled engaging surfaces engage correspondingly angled surfaces on the wear member. The angle of these surfaces allows limited 'rocking' movement of the engaging surfaces relative to one another under transverse loads on the wear member.

Each engaging surface is a generally planar surface, but it would be understood by persons skilled in the art that the engaging surfaces may be provided with a curvature in some embodiments.

Each locking element may comprise a head portion, side surface portions of the head portion defining the engaging surface(s) for engaging the wear member.

In some embodiments, each head portion may be generally circular or disc-like in cross-section, but in other embodiments the head portion may have other non-circular shapes.

The side surface of each head portion may be shaped so that width of each head portion is tapered across its depth. This tapering enables the locking element to take-up any wear on the lock element and/or the wear member.

In other arrangements, the side surface of the at least one head portion may be stepped, concave or convex in shape across the head portion's depth.

In further embodiments, only the side surface portions of the head portion which define the engaging surfaces are tapered.

The cross-sectional area of the head portion at its end surface furthest from the lock body may be greater than the cross-sectional area of the head portion at its end surface closest to the lock body.

The locking element may be rotated so as to move towards (and away) from the lock body.

Each locking element may comprise an arm to which the head portion is mounted, the arm moveable into and out of the lock body to adjust the lock between its extended and retracted configurations.

Each arm may be rotatable relative to the lock body so as to move the arm into and out of the lock body depending on the direction of rotation.

The lock may comprise at least one tool engagement location where a tool may engage the lock to adjust the lock between its extended and retracted configurations.

The tool engagement location may comprise a hexagonal indentation in the external end surface of the head portion.

The lock may comprise two locking elements.

The locking elements may comprise head portions mounted on the ends of arms extending from either side of the lock body, each head portion defining at least one, preferably two engaging surfaces for engaging the wear member.

The arms may be configured such that rotation of either one of the arms causes both arms to be moved into or out of the lock body, preferably at the same rate of movement relative to the lock body.

The arms may be configured to be rotatable independently of one another.

The arms may be coupled together.

One of the arms may comprise a groove for receiving a stopper to stop rotation of that arm.

The groove may have a defined length, the groove thereby configured to limit the translational movement of one of the arms by its defined length when a stopper is received in the groove.

The locking elements may be coupled together, in one embodiment by a coupling member preferably so that movement of either of the locking elements results in a corresponding movement in the opposite direction of the other of the locking elements, preferably at the same rate of movement relative to the lock body.

The coupling member may be housed within the lock body.

The coupling member may connect at a first end to one locking element and at an opposed second end to the other locking element.

The coupling member may be threaded.

The coupling member may be configured so that it is allowed to rotate but prevented from translating with respect to the lock body.

The coupling member may act as an actuator for movement of both locking elements, whereby the coupling member is rotated to cause translation but not rotation of both locking elements.

The coupling member may have a circumferential groove for receiving a stopper to stop translation but allow rotation of the coupling member. In this embodiment, the arms of each locking element may have an elongate groove for receiving a stopper to stop rotation by allow translation of each locking element.

Each arm may have shaped portions that enable the arm to be spaced from engagement with the wear member when the engaging portion is engaging the wear member. This allows limited 'rocking' movement of the wear member with respect to the digging device when they are locked in their assembled condition by the lock.

The shaped portions may comprise flat surfaces, preferably formed in opposed sides of each generally cylindrical arm. Although, it will be understood by persons skilled in the art that the surfaces could in some embodiments be curved.

The shaped portions may be formed as one or more recesses in each arm, preferably as recesses in opposed sides of each arm.

The lock may comprise a first engaging portion which engages a first surface of the wear member when the lock is in its locking configuration and a second engaging portion which engages a second surface of the wear member when the lock is in its locking configuration such that a portion of the wear member is clamped by the first and second engaging portions.

The first engaging portion may comprise one of the locking elements, in particular a head portion of that locking element.

The second engaging portion may comprise a flange portion formed on the lock body.

According to a further embodiment of the disclosure, there is provided a wear member for a wear assembly, the wear member comprising:

a body that extends along a longitudinal axis between first and second ends;

a socket extending into the body from the second end, the socket being defined by an inner surface of the body; and at least one slot extending from said second end and along said inner surface.

The wear member may comprise two slots extending from the second end of the wear member and along the inner surface of the socket on opposing sides of the wear member.

Each slot may end in a discontinuity.

The wear member may comprise at least one engaging surface which defines a portion of its respective slot, each engaging surface for a locking element to engage to lock the wear member to in an assembled condition with another member.

The another member may be a portion of a digging device or a further wear member for example.

Each engaging surface may be the inner surface of a truncated conical segment through the inner surface of the wear member body.

Each engaging surface may be defined by an engaging portion of its respective slot.

Each engaging surface may be angled away from a central axis of the engaging portion as the engaging surface extends away from the socket, the central axis of the engaging portion being transverse to the longitudinal axis of the wear member.

Each engaging surface may extend transversely to the longitudinal axis of the wear member body. This allows limited 'rocking' movement of the wear member relative to the digging device, when in the assembled condition, under transverse loads to the longitudinal axis of the wear member body.

In another form, the wear member comprises at least one engaging surface, each engaging surface for a locking element to engage to lock the wear member in an assembled condition with another member and wherein each engaging surface is angled towards the first end of the wear member body as the engaging surface extends away from one of the slots. This also allows limited 'rocking' movement of the wear member relative to the digging device, when in the assembled condition, under transverse loads to the longitudinal axis of the wear member body.

The wear member preferably comprises two engaging surfaces associated with each slot.

Each engaging surface may be angled with respect to the other engaging surface of that slot, preferably at an obtuse angle.

Each engaging surface is a generally planar surface, but it would be understood by persons skilled in the art that the engaging surfaces may be provided with a curvature in some embodiments.

Each slot may also comprise an external window to enable tool access to a locking element projecting from another member to which the wear member is to be assembled.

Each slot may comprise a clearing portion for clearing a locking element projecting from another member when assembling the wear member with the member.

Each clearing portion may at one end open at the second end of the wear member.

At the opposite end of each clearing portion to the second end may be an engaging surface, the engaging surface for a locking element to engage to lock the wear member to another member.

Each clearing portion may comprise an elongate passage extending from the second end of the wear member.

Each clearing portion may be open through the inner surface of the body.

The opening of each clearing portion to the socket may be narrowed by opposing lips.

The lips may have bevelled or curved edges at their external vertices.

Each clearing portion may be open through an outer surface of the body.

Each clearing portion may increase in height towards the outer surface of the body.

Each clearing portion may be closed on its external side by the outer surface of the body.

According to a further aspect of the disclosure, there is provided a wear member for a wear assembly comprising a body having opposite first and second ends, a socket extending into the body from the second end, the socket being defined by an inner surface of the body, at least one slot extending from said second end and along said inner surface, and an engaging surface which defines a portion of said slot and which forms a discontinuity in said slot, the engaging surface for a locking element to engage to lock the wear member in an assembled condition with another member According to a further aspect of the disclosure, there is provided a method of assembling a wear member to a digging device, the method comprising:

mounting a lock to the digging device and adjusting the lock into an extended configuration so that at least one locking element of the lock projects outwardly from its mounting;

assembling the wear member to the digging device; prior to adjusting the lock from its extended configuration towards a retracted configuration by moving the locking element inwardly towards its mounting, thereby causing the wear member to be locked to the digging device.

Mounting the lock to the digging device may comprise mounting the lock directly to a portion of the digging device.

In another embodiment, mounting the lock may comprise mounting the lock to a further wear member that is disposed on the digging device. In this embodiment, assembling the wear member to the digging device comprises assembling the wear member with the further wear member, preferably by receiving a nose portion of the further wear member in a socket of the wear member.

According to a further aspect of the disclosure, there is provided a wear assembly for attachment to a digging device, the wear assembly comprising:

a wear member arranged to be assembled with the digging device in an assembled condition; and a lock mounted to the digging device, the lock adjustable between a locking configuration in which it locks the wear member in its assembled condition with the digging device and an unlocked configuration in which the wear member is free to move into and out of its assembled condition with the digging device, the lock comprising at least one locking element that projects outwardly from its mounting, each locking element having an arm mounted to the digging device and an engaging portion for engaging the wear member connected to the arm, wherein the arm is shaped so that portions of the arm are spaced from engagement with the wear member when the engaging portion is engaging the wear member to thereby allow limited movement of the wear member with respect to the digging device when they are locked in their assembled condition The shaped portions may comprise flat surfaces, preferably formed in opposed sides of each generally cylindrical arm.

Although, it will be understood by persons skilled in the art that the surfaces could in some embodiments be curved.

The shaped portions may be formed as one or more recesses in each arm, preferably as recesses in opposed sides of each arm.

According to a further aspect of the disclosure, there is provided a lock for locking a wear member to a digging device, the lock adjustable between a locking configuration and an unlocking configuration, the lock comprising:

a body; and at least one locking element that projects outwardly from the body, each locking element having an arm mounted to the body and an engaging portion for engaging the wear member connected to the arm, wherein the arm has shaped portions that enable the arm to be spaced from engagement with the wear member when the engaging portion is engaging the wear member.

The shaped portions may comprise flat surfaces, preferably formed in opposed sides of each generally cylindrical arm. Although, it will be understood by persons skilled in the art that the surfaces could in some embodiments be curved.

The shaped portions may be formed as one or more recesses in each arm, preferably as recesses in opposed sides of each arm.

According to a further aspect of the disclosure, there is provided a wear assembly for attachment to a digging device, the wear assembly comprising:

a wear member arranged to be assembled with the digging device in an assembled condition; and a lock mounted to digging device, the lock adjustable between a locking configuration in which it locks the wear member to the digging device and an unlocked configuration in which the wear member is free to move into and out of its assembled condition with the digging device; wherein the lock comprises a first engaging portion which engages a first surface of the wear member when the lock is in its locking configuration and a second engaging portion which engages a second surface of the wear member when the lock is in its locking configuration such that a portion of the wear member is clamped by the first and second engaging portions.

According to a further aspect of the disclosure, there is provided a lock for locking a wear member to a digging device the lock adjustable between a locking configuration and an unlocking configuration, the lock comprising: a body;

a first engaging portion for engaging a first surface of the wear member when the lock is in its locking configuration; and a second engaging portion for engaging a second surface of the wear member when the lock is in its locking configuration such that a portion of the wear member is clamped by the first and second engaging portions.

The first engaging portion may comprise a locking element that projects outwardly from a lock body and the second engaging portion may comprise a flange portion formed on the lock body.

According to a further aspect of the disclosure, there is provided a wear assembly for attachment to a digging device, the wear assembly comprising:

a wear member arranged to be assembled with the digging device in an assembled condition and having a body that extends along a longitudinal axis between a first end and an opposite second end;

a lock mounted to the digging device, the lock adjustable between a locking configuration in which it locks the wear member in its assembled condition with the digging device and an unlocked configuration in which the wear member is free to move into and out of its assembled condition with the digging device; and engaging surfaces on the lock and the wear member which engage to lock the wear member in its assembled condition with the digging device, the engaging surfaces extending transversely to the longitudinal axis of the wear member to allow limited movement of the engaging surfaces relative to one another under transverse loads on the wear member.

The wear assembly may comprise at least two engaging surfaces on each of the lock and the wear member.

The engaging surfaces on the lock and the wear member respectively, are angled with respect to each other, preferably at an obtuse angle. The angled engaging surfaces enable movement in two directions.

Each engaging surface may be angled towards the first end of the wear member body.

According to a further aspect of the disclosure, there is provided a wear member comprising:

a body that extends along a longitudinal axis between a first end and an opposite second end; and at least one engaging surface for engagement with a lock to lock the wear member in an assembled condition with a digging device, each engaging surface extending transversely to the longitudinal axis of the wear member body to thereby allow limited movement of the wear member relative to the digging device, when in the assembled condition, under transverse loads.

The wear member may comprise two engaging surfaces that are angled with respect to each other, preferably at an obtuse angle.

Each engaging surface may be angled towards the first end of the wear member body.

According to a further aspect of the disclosure, there is provided a lock for locking a wear member in an assembled condition with a digging device the lock adjustable between a locking configuration and an unlocking configuration, the lock comprising:

a body; and at least one locking element for locking the wear member to lock the wear member in its assembled condition with the digging device, each locking element having two engaging surfaces for engaging the wear member, the engaging surfaces angled with respect to one another.

According to a further aspect of the present disclosure there is provided a wear assembly for attachment to a digging device, the wear assembly comprising:

a wear member arranged to be assembled with the digging device in an assembled condition; and a lock mounted to the digging device, the lock adjustable between a locking configuration in which it locks the wear member in its assembled condition with the digging device and an unlocked configuration in which the wear member is free to move into and out of its assembled condition with the digging device, the lock comprising two locking elements that project outwardly in opposing directions from its mounting and a coupling member that couples to both lock elements such that movement of either of the locking elements results in a corresponding movement in the opposite direction of the other of the locking elements.

According to a further aspect of the disclosure, there is provided a lock for locking a wear member to a digging device the lock adjustable between a locking configuration and an unlocking configuration, the lock comprising:

a body;

two locking elements that project outwardly in opposing directions from the body; and a coupling member that couples to both lock elements such that movement of either of the locking elements results in a corresponding movement in the opposite direction of the other of the locking elements.

The coupling member may be housed within the lock body.

The coupling member may connect at a first end to one locking element and at an opposed second end to the other locking element.

The coupling member may be threaded.

The coupling member may be configured so that it is allowed to rotate but prevented from translating with respect to the lock body.

The coupling member may act as an actuator for movement of both locking elements, whereby the coupling member is rotated to cause translation but not rotation of both locking elements.

The coupling member may have a circumferential groove for receiving a stopper to stop translation but allow rotation of the coupling member. In this embodiment, the arms of each locking element may have an elongate groove for receiving a stopper to stop rotation by allow translation of each locking element.

BRIEF DESCRIPTION OF THE DRAWINGS

Embodiments will now be described, by way of example only, with reference to the accompanying drawings in which:

(FIG. 5 is shown transparently);

FIG. 11 is a perspective view of the intermediate member and the lock showing how the lock is positioned relative to the intermediate member when the intermediate member is coupled to the adapter;

FIG. 12 is a side view of FIG. 11;

FIG. 13 is a top sectional view through A-A of FIG. 12;

FIG. 17 is a transparent perspective view of the lock of FIG. 15;

FIGS. 18 and 19 are perspective views of the arms of the lock of FIG. 15 in isolation;

DETAILED DESCRIPTION OF EMBODIMENTS

Figure 3:
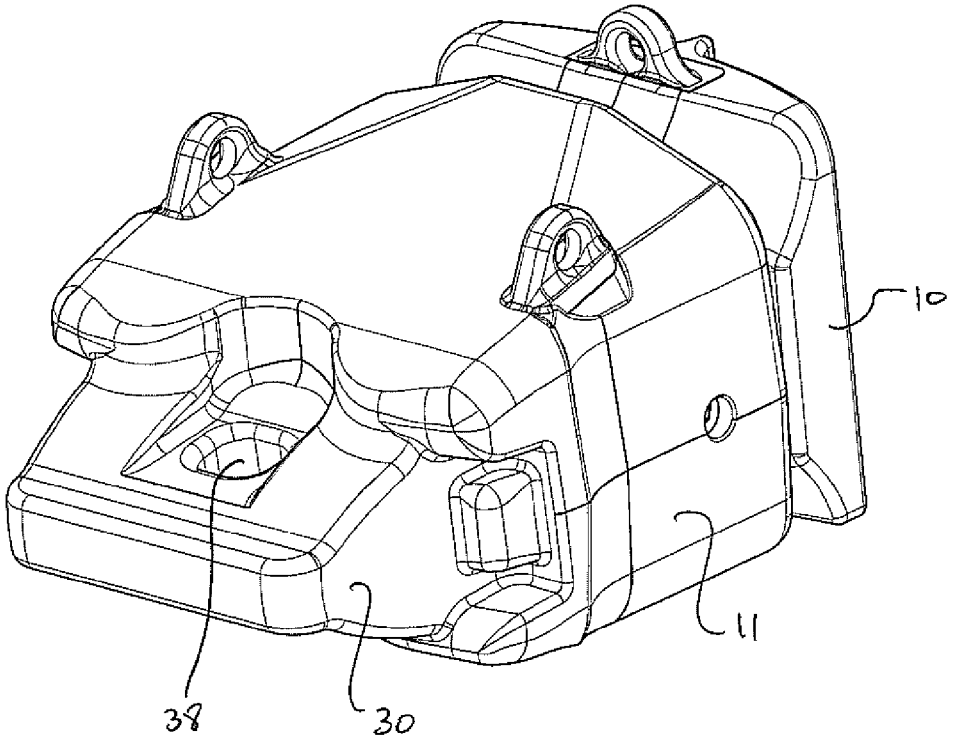
FIGS. 3 and 4 are perspective views of the intermediate member of FIGS. 1 and 2 coupled to a further wear member in the form of an adapter of the excavation tooth assembly.
Figure 4:
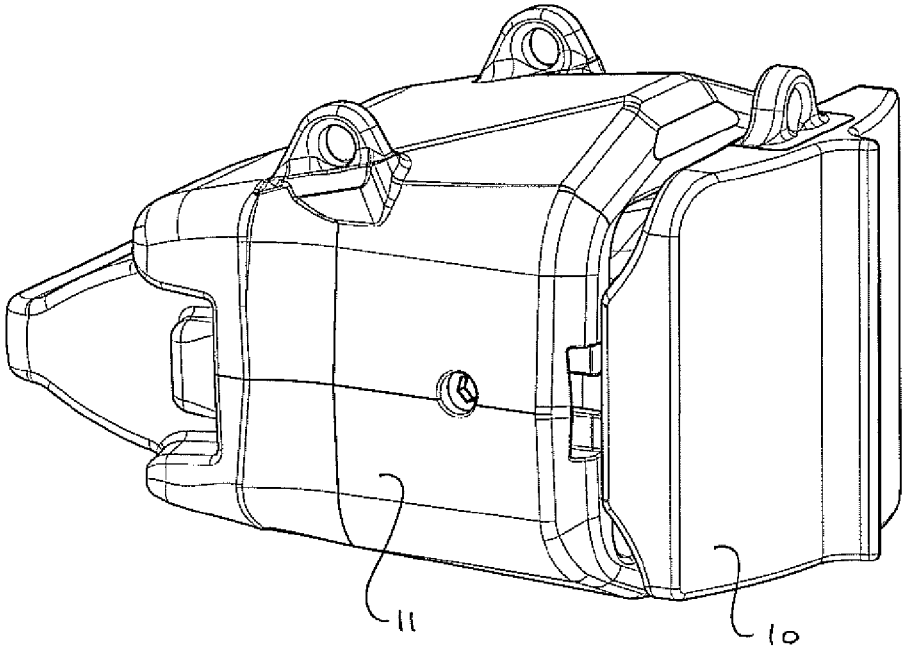

Referring to FIGS. 1-13, various components of a wear assembly in the form of an excavation tooth assembly are shown. In particular, these Figures show an adapter 10 for mounting the excavation tooth assembly a digging device, an intermediate member 11 which couples to the adapter 10 in an assembled condition (see FIGS. 3 and 4) and a lock 12 for locking the intermediate member to the adapter, the lock being mounted to the intermediate member. Not shown in these Figures, but also forming a part of the excavation tooth assembly, is a point which couples to the intermediate member 11 and comprises a digging edge which engages the ground in use. The excavation tooth assembly also comprises a further lock to lock the point to the intermediate member.

Figure 5:
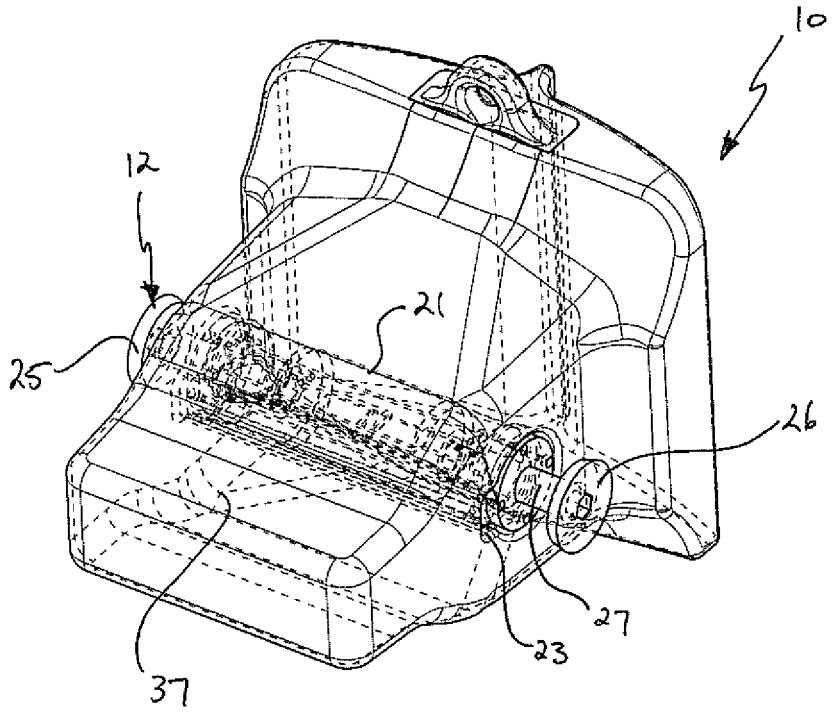
FIGS. 5 and 6 are perspective views of the adapter with a lock according to an embodiment residing in a cavity of the adapter
Figure 6:
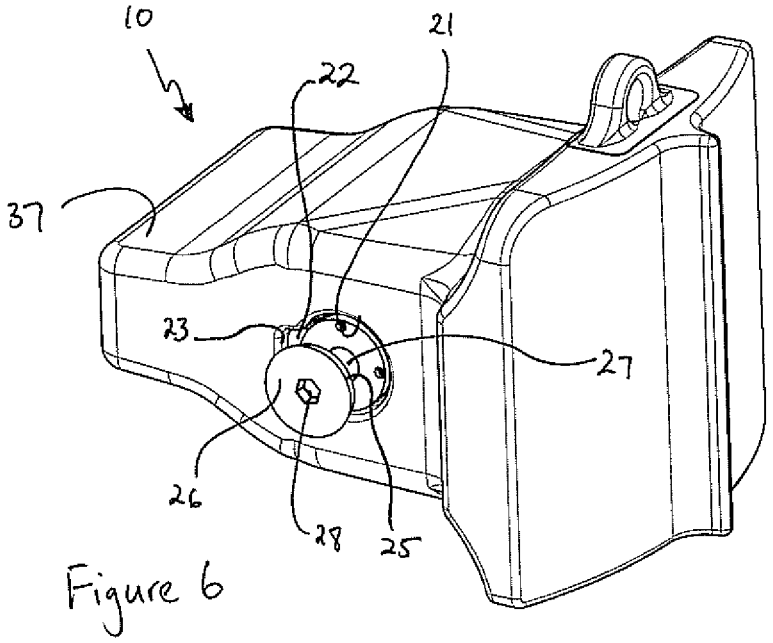

The lock 12 comprises a body 20 which is generally cylindrical and is configured to reside in a cavity 21 of the adapter 10 (as shown for example in FIGS. 5 and 6). The lock body 20 comprises a ridge 22 which is received in a corresponding groove 23 of the adapter cavity. The purpose of the ridge 22 is to prevent the lock body from rotating once inserted into the cavity 21. However, it is to be understood that the lock could be mounted to the intermediate member, including by surface mounting.

The lock 12 also comprises locking elements in the form of disc-like head portions 26 mounted on the end of arms 27 extending from either side of the lock body 20. The arms 27 are partly located inside the body 20. The side surfaces 25 of the head portions provide engaging surfaces, the purpose of which will be described below. The head portions 26 are tapered such that the cross-sectional area of each head portion at its end surface furthest from the lock body is greater than the cross-sectional area of each head portion at its end surface closest to the lock body. In other embodiments not shown in the Figures, the side surfaces of the head portions 26 may be stepped, concave or convex in shape across their depth. However, the tapered shape advantageously allows the lock to be readily tightened after the lock and/or the point have become worn or when used with already worn parts.

Figure 7:
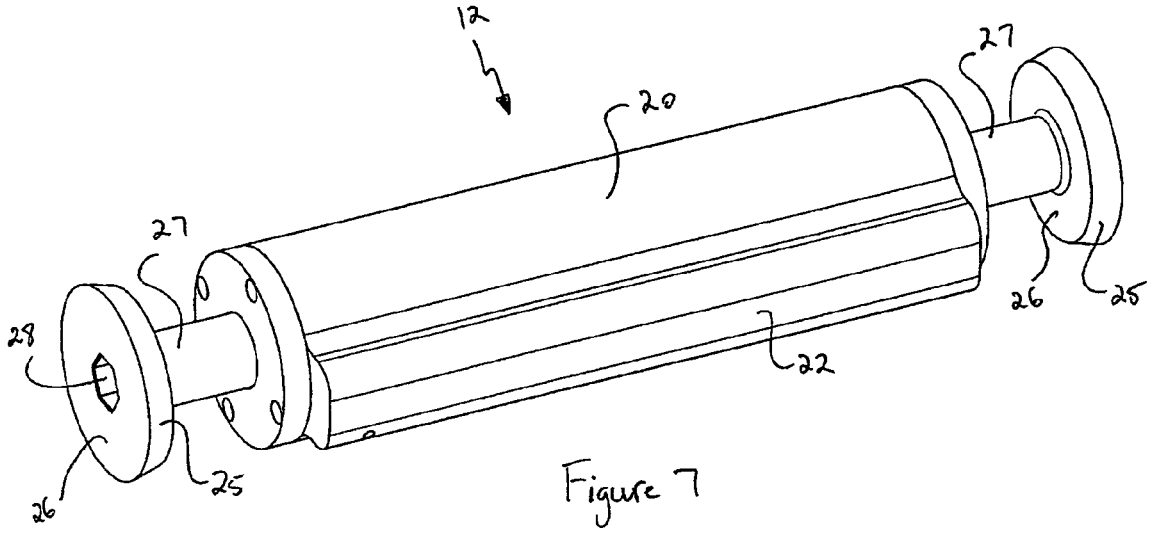
FIG. 7 is a perspective view of the lock according to an embodiment in an extended configuration.
Figure 8:
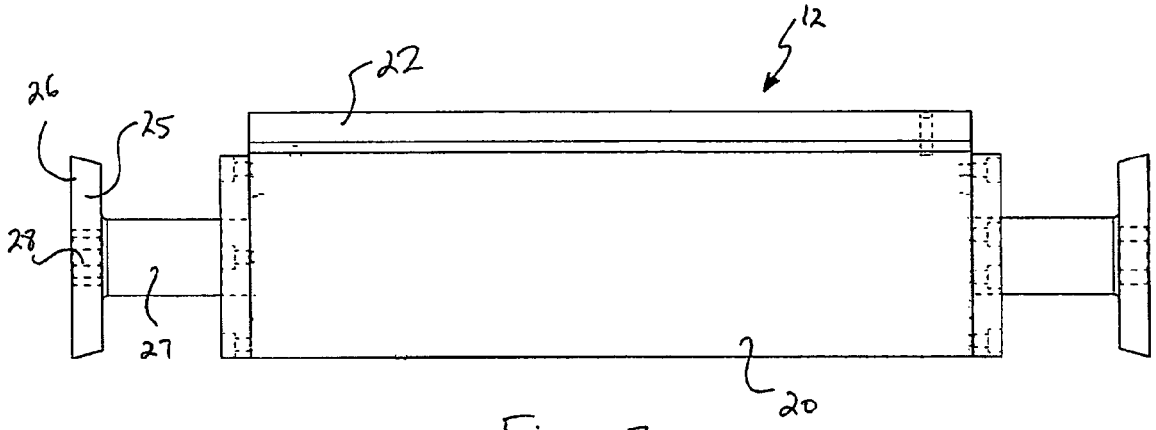
FIG. 8 is a top view of the lock in its extended configuration.

The arms 27 are rotatable relative to the lock body 20. Rotation of each arm causes the arm to be drawn into or extended out of the lock body depending on the direction of rotation. Accordingly, the lock 12 may be adjusted between an extended configuration as shown in FIGS. 7 and 8 for example and a retracted configuration as shown in FIG. 13 for example. In the extended configuration the locking elements (head portions 26 and arms 27) project outwardly from the lock body and from the intermediate member to which the lock is mounted. Adjustment of the lock from this extended configuration to the retracted configuration involves movement of the locking elements inwardly towards lock body and the intermediate member The lock 12 also comprises tool engagement locations in the form of hexagonal indentations 28 in the external end surface of each head portion 26. An appropriately shaped tool may be inserted by a user into one of the hexagonal indentations 28 to rotate the head portion 26 (and arm 27) so as to adjust the lock between its extended and retracted configurations.

The arms 27 may be configured such that rotation of either one of the arms causes rotation of the other arm so that both arms to be drawn into or extended out of the lock body, depending on the direction of rotation at the same time and generally at the same rate. In another configuration, the arms 27 are rotated independently such that each arm has to be rotated independently to be drawn into or extended out of the lock body as required.

The intermediate member 11 comprises a body having a nose portion 30 at a first end and a socket 31 extending into the body from an opposite second end. The socket 31 opens in the second end face 32. The socket is defined by top and bottom inner surfaces 33,34 and side inner surfaces 35,36 of the body of the intermediate member. The socket 31 thus has a generally rectangular cross section, although it could be defined by additional surfaces such that the socket had a non-rectangular cross section. The socket 31 is configured to receive a nose portion 37 of the adapter 10. The cavity 21 of the adapter in which the lock 12 is mounted is formed in its nose portion 37.

The nose portion 30 of the intermediate member is configured to be received in a socket of the point of the excavation tooth assembly. A cavity 38 is provided in the nose portion 30 of the intermediate member for receipt of a lock (not shown) for locking the point to the intermediate member. Due to the design of the intermediate member, a different lock from the lock 12 shown and described for locking the intermediate member to the adapter would need to be used to lock the point to the intermediate member. However, the intermediate member (and the point) could be designed so that the same or similar lock to the lock 12 could be used to lock the point to the intermediate member.

To couple the intermediate member 11 to the adapter 10 in assembling the excavation tooth assembly, the lock 12 adjusted towards its extended configuration is first inserted into the cavity 21 in the adapter 10. In this position, the arms 27 of the lock project out of the cavity 21 on either side of the adapter 10. The intermediate member is then coupled to the adapter by inserting the nose portion 37 of the adapter in the intermediate member socket 31. In this coupling process, the intermediate member clears the arms and head portions of the lock 12 protruding from the adapter cavity 21. Once the intermediate member is coupled to the adapter, the lock 12 is adjusted towards its retracted position so as to lock the intermediate member to the adapter. The lock 12 provides a clamping or bracing action between the intermediate member 11 and the adaptor 10. This is a strong locking mechanism to lock the intermediate member and the adaptor in their assembled condition.

To enable the intermediate member 11 to clear the head portions 26 and arms 27 of the lock 12 as it is being coupled to the adapter, the intermediate member also comprises slots 40 opening in the second end face 32 of the intermediate member. One of the slots 40 extends from the second end of the intermediate member along each of the inner side surfaces 35, 36 which define the socket 31.

The following description of the slot features applies to each slot 40. The slot 40 comprises an engaging portion 41 in which the engaging surface of one of the head portions of the lock engages the intermediate member and a clearing portion 42 which clears over the head portions 26 and arms 27 of the lock 12 as the intermediate member 11 is being coupled to the adapter. The clearing portion 42 at one end opens in the second end face 32 of the intermediate member. At the opposite end of the clearing portion 42 to the second end face 42 is the engaging portion 41, which provides a discontinuity in the shape of the slot extending from the second end face 32. In use, once the clearing portion 42 has cleared the head portion and arm, the head portion is located in the engaging portion.

The engaging portion 41 comprises a space extending into the inner side surface of the body. The space may or may not extend through to the outer side surface of the intermediate member's body. The slot 40 also comprises an engaging surface 43 formed in the engaging portion 41 which the engaging surface 25 of one of the head portions 26 of the lock engages when the lock is adjusted towards its retracted configuration. The engaging surface 43 comprises at least a part of the surface defined by the engaging portion space. The engaging surface 43 is angled away from a central axis of the engaging portion as it extends away from the internal surface of the side walls 35, 36. It is noted that the central axis of the engaging portion extends transversely, preferably orthogonally with respect to the longitudinal axis of the intermediate member 11.

The diameter of the engaging surface 43 at its most distant edge from the socket 31 is greater than the maximum diameter of the head portions 26 of the lock 12 and the diameter of the engaging surface 43 at its closest edge to the socket 31 is less than the minimum diameter of the head portions 26 of the lock 12. The engaging surface thus defines a truncated conical segment of the engaging portion. This enables the correspondingly shaped head portions 26 of the lock 12 to appropriately engage the engaging surface 43.

The engaging portion 41 also comprises an external window 44. The external window 44 provides an opening through the outer side surface of the body of the intermediate member to the engaging portion 41. The external window 44 is configured in particular to allow for access to the hexagonal depression 28 in one of the head portions 26 of the lock 12 with a tool for rotating the head portion 26 and thereby adjusting the lock between its extended and retracted positions. The centre of the external window 44 aligns with the centre of the aperture of the engaging portion 41. Although the external window 44 is shown in the Figures to be of generally circular cross-section, it could be of any suitable shape. The external window 44 in the embodiments shown in FIGS. 1 to 13 is much smaller than the head portions 26 of the lock so that the head portions 26 cannot inadvertently move into the external window 44.

The clearing portion 42 provides an opening through the inner side surface of the intermediate member body from the second end face 32 of the member to the engaging portion 41.

The clearing portion 42 comprises an elongate passage 45 extending from the second end face 32 of the intermediate member. The elongate passage 45 is closed on its external side by its respective outer side surface of the intermediate member body. This closure creates a 'bridge' across the slot 30 on the outside of the intermediate member body, providing the intermediate member with greater strength and integrity and protecting the lock's head portions. The elongate passage 45 opens through the inner side surface 35, 36 to the socket 31 but is also narrowed along the side of the passage adjacent to the inner side surface of the intermediate member body by lips 46,47. The lips 46,47 integrally form part of the side wall 35,36 as well as part of the second end face 32 of the intermediate member. The lips 46,47 are spaced apart at a generally constant distance which is greater than the width of the arms 27 but less than the width of the head portions 26 of the lock 12. This is so that as the intermediate member is coupled to the adapter, the lips 46,47 clear above and below the arms 27 of the lock but prevent the head portions 26 from inadvertently slipping into the socket 31 of the intermediate member. The lips 46,47 have bevelled or curved edges 48,49 at their external vertices which form part of the second end face 32 of the intermediate member. These edges 48,49 act to guide the arms 27 into the slot 40 when coupling the intermediate member to the adapter.

The coupling and locking of the intermediate member 11 to the adapter 10 will now be described:

Referring to FIGS. 5 and 6, the first step of the coupling process involves inserting the lock 12 into the cavity 21 in the adapter 10 whilst the lock is arranged in or close to its extended configuration. Insertion of the lock requires the alignment of the ridge 22 of the lock with the groove 23 of the adapter. As can be seen in FIGS. 5 and 6, when the lock is inserted in its extended configuration, the arms 27 and the head portions 26 project out of the cavity 21 whilst the lock body 20 remains contained within the cavity.

Figure 9:
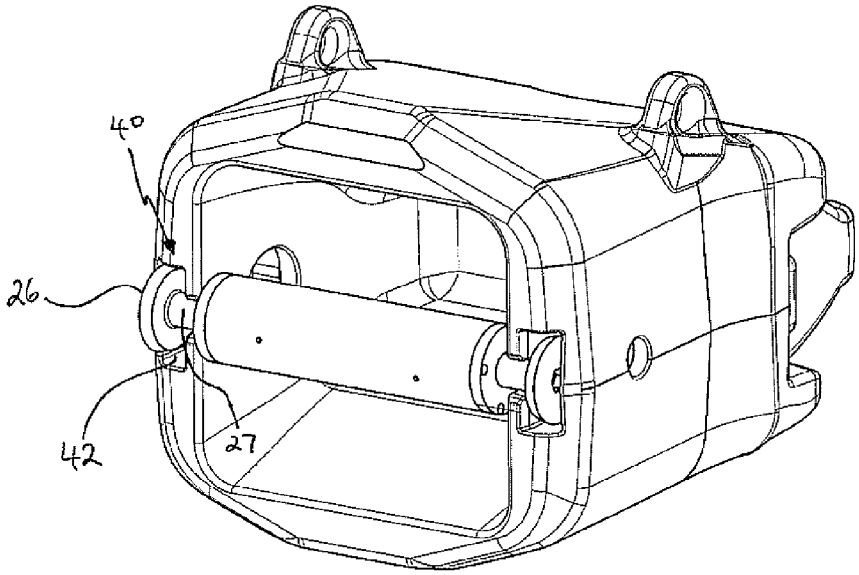
FIGS. 9 and 10 are perspective and end views of the intermediate member and the lock which show how the intermediate member clears the lock when a nose portion of the adapter is being received in a socket of the intermediate member with the lock residing in the adapter cavity.
Figure 10:
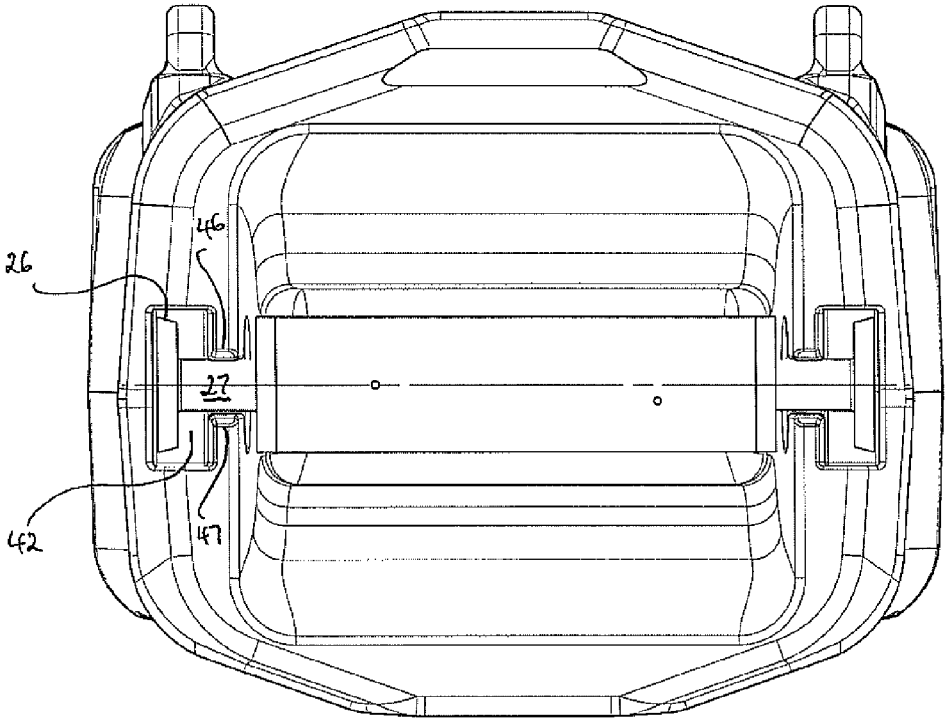

The intermediate member 11 can now be coupled to the adaptor 10 by receiving the nose portion 37 of the adapter in the socket 31 of the intermediate member. As this occurs, the slots 40 of the intermediate member are aligned with and enable the member to clear the head portions 26 and arms 27 of the lock 12. FIGS. 9 and 10 show this alignment (with the adaptor 10 omitted for clarity). As seen in these Figures, the clearing portion 42 of each slot 40 fits around the head portions 26 of the lock, with the lips 46,47 passing above and below the arms 27 of the lock. The head portions 26 and arms 27 are thus received in the slots 40 of the intermediate member 11.

When the adaptor nose portion 37 is fully received in the socket 31 of the intermediate member, the head portions 26 and arms 27 are located in the engaging portions 41 at the ends of the slots 40 inside the inner side surfaces 35, 36 of the intermediate member as shown in FIG. 12 (with the adapter 10 omitted for clarity). In this location, the hexagonal depression 28 in the head portions 26 can be seen and accessed by a tool through the external windows 44 of the slots 40 as shown in FIGS. 10 and 11. The lock 12 is thus adjusted towards its retracted position by inserting a tool through one of the external windows 44 and into one of the depressions 28 and rotating the head portion 26. This causes one or both arms 27 (depending on the configuration of the lock 12) to retract into the lock body 20 and for the head portions 26 to move towards the engaging surfaces 43 of the slots 40. Rotation of the head portion using the tool continues until the engaging side surfaces 25 of the head portions engage the engaging surface 43 of the engaging portions 41 as shown in FIG. 13. This engagement locks the intermediate member 11 to the adapter 10. The lock is not in its fully retracted configuration at this point but can be further adjusted towards its retracted configuration in order to allow for tightening of the lock 12 in its engagement with the intermediate member 11 as the parts wear in use.

Referring now to FIGS. 14 to 19, a wear member in the form of an intermediate member 111 and a lock 112 for locking the intermediate member to an adapter in an excavation tooth assembly according to another embodiment of the present invention is shown. Similar features of the intermediate member 111 and the lock 112 to the intermediate member 11 and lock 12 shown and described in respect of FIGS. 1 to 13 have been designated with the same reference number but prefixed with the numeral 1.

Figure 1:
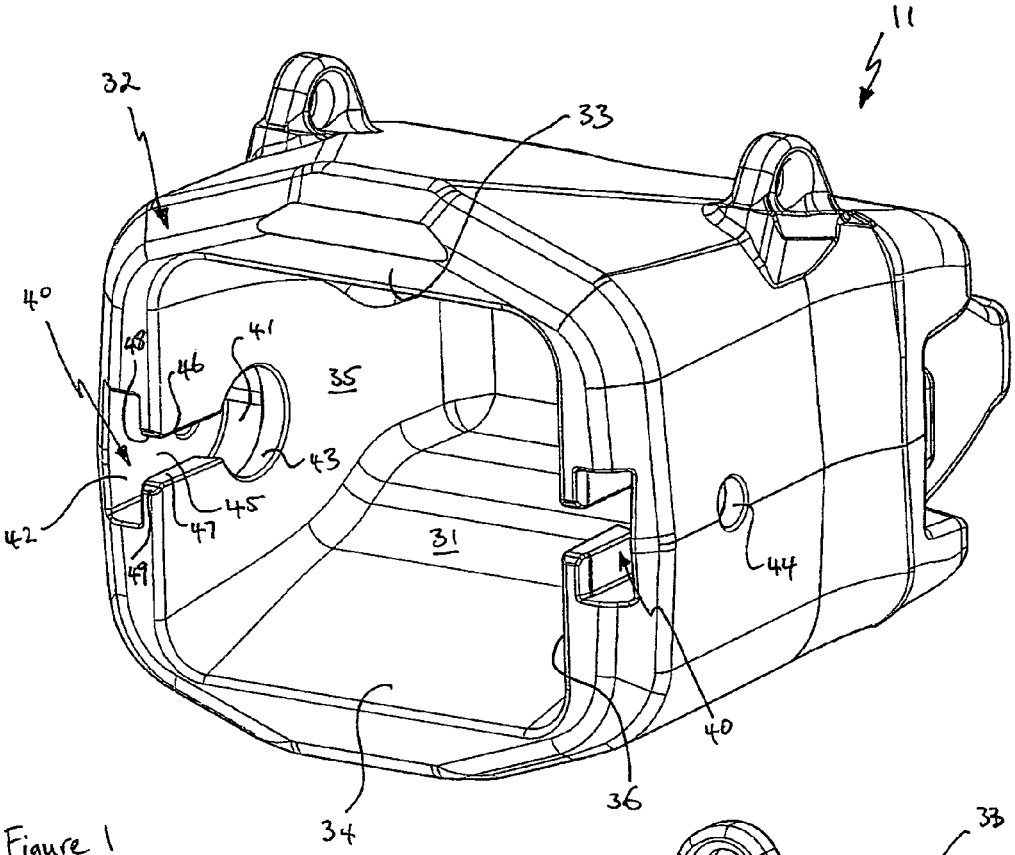
FIGS. 1 and 2 are perspective views of a wear member in the form of an intermediate member of an excavation tooth assembly according to an embodiment.
Figure 2:
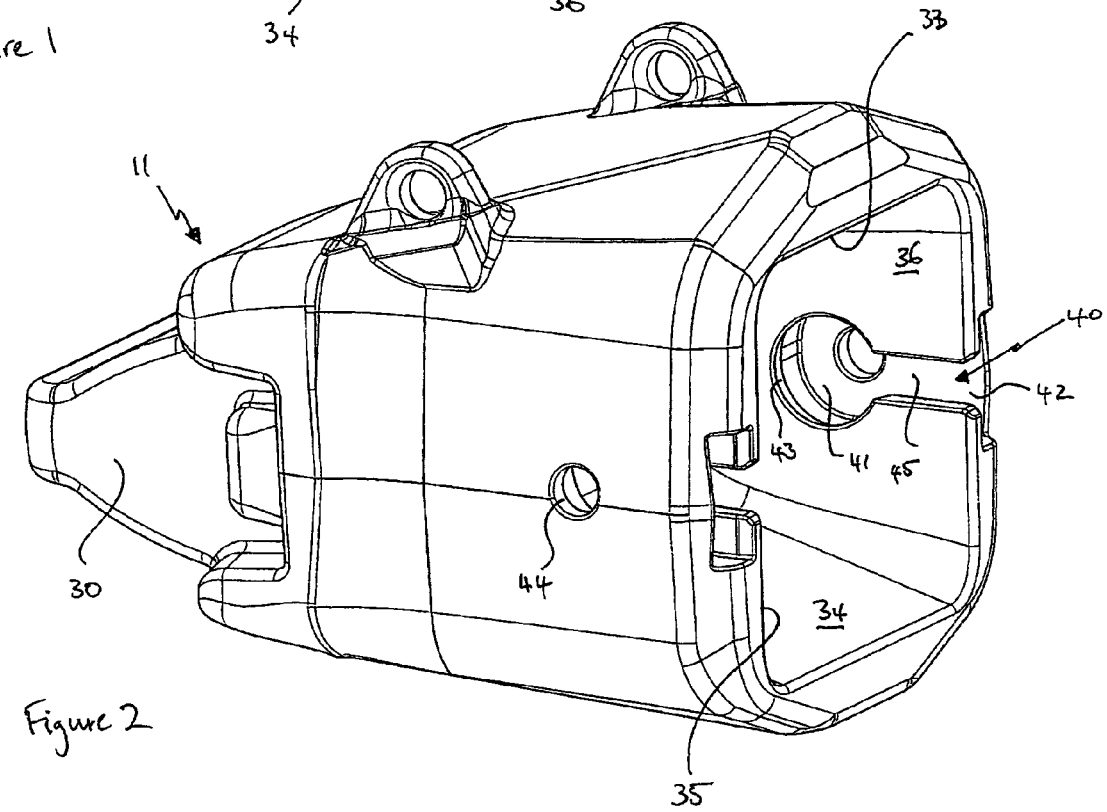
Figure 14:
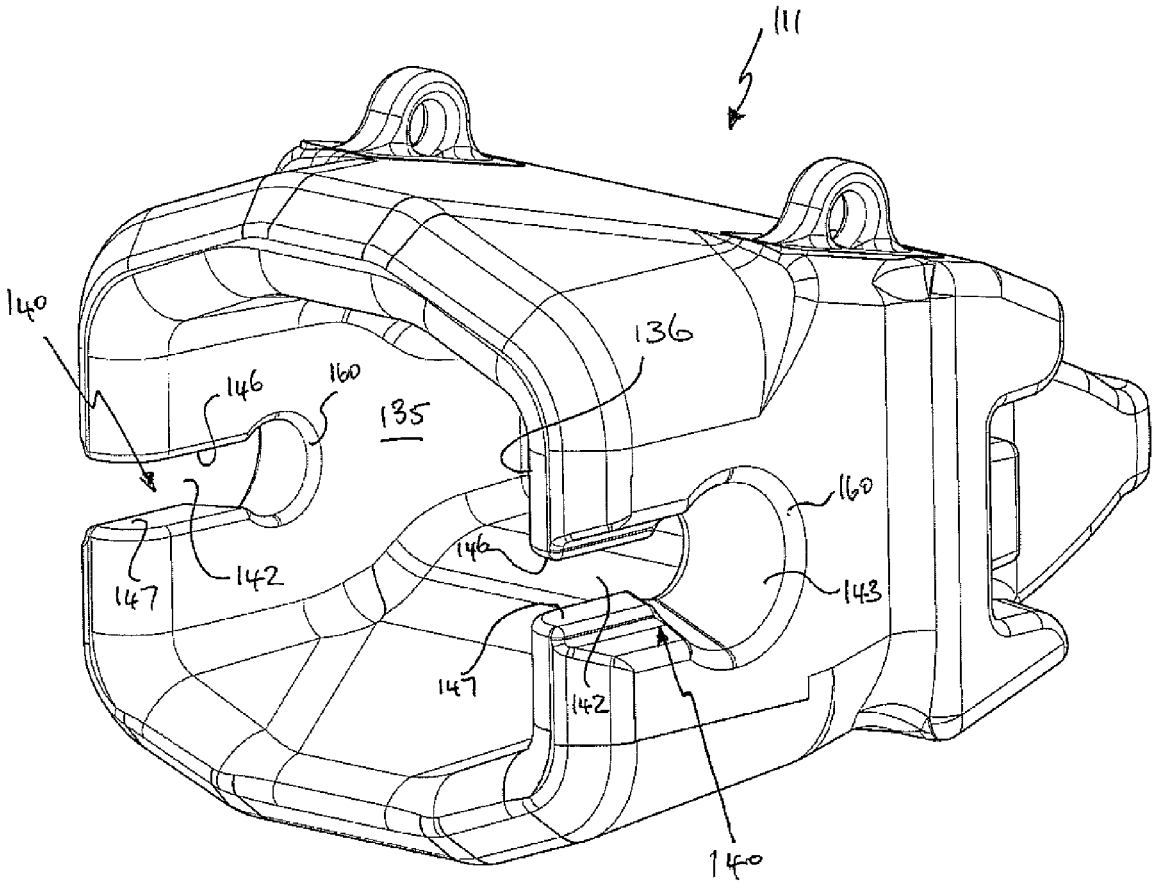
FIG. 14 is a perspective view of a wear member in the form of an intermediate member of an excavation tooth assembly according to another embodiment.
Figure 16:
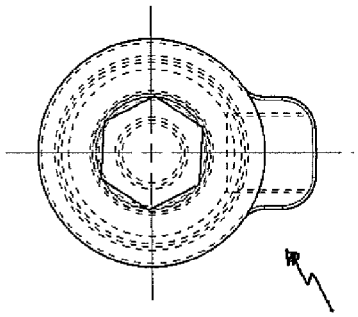
FIG. 16 is a transparent end view of the lock of FIG. 15.
Figure 15:
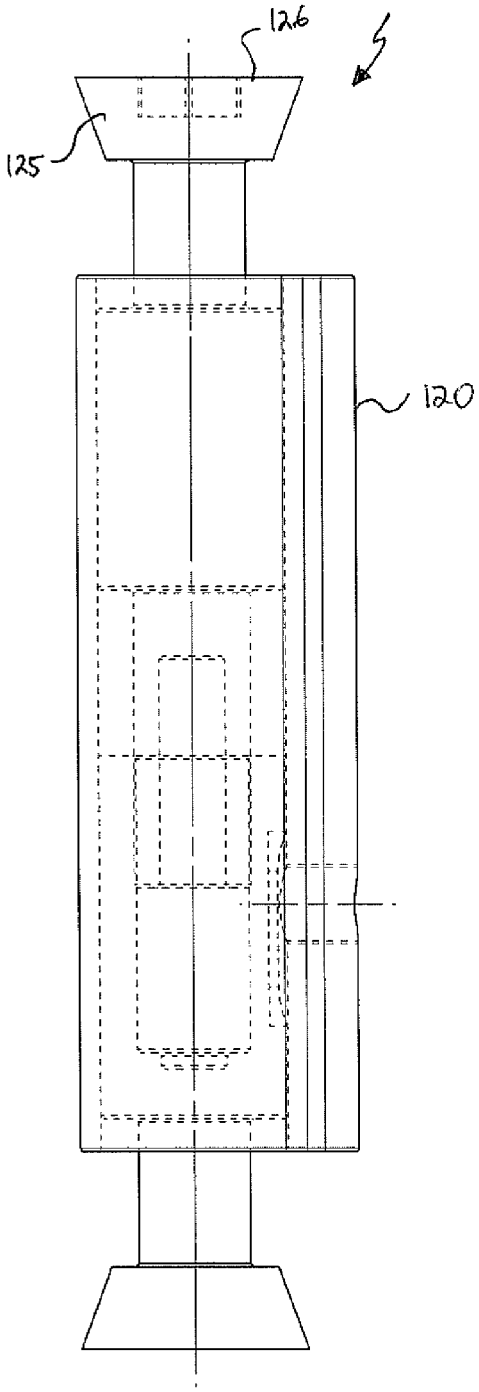
FIG. 15 is a transparent top view of a lock according to another embodiment.
Figure 20:
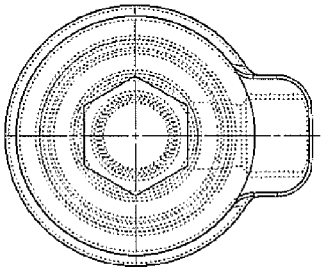
FIGS. 20 to 24 are end, perspective, top and part views of a lock according to a further embodiment.
Figure 21:
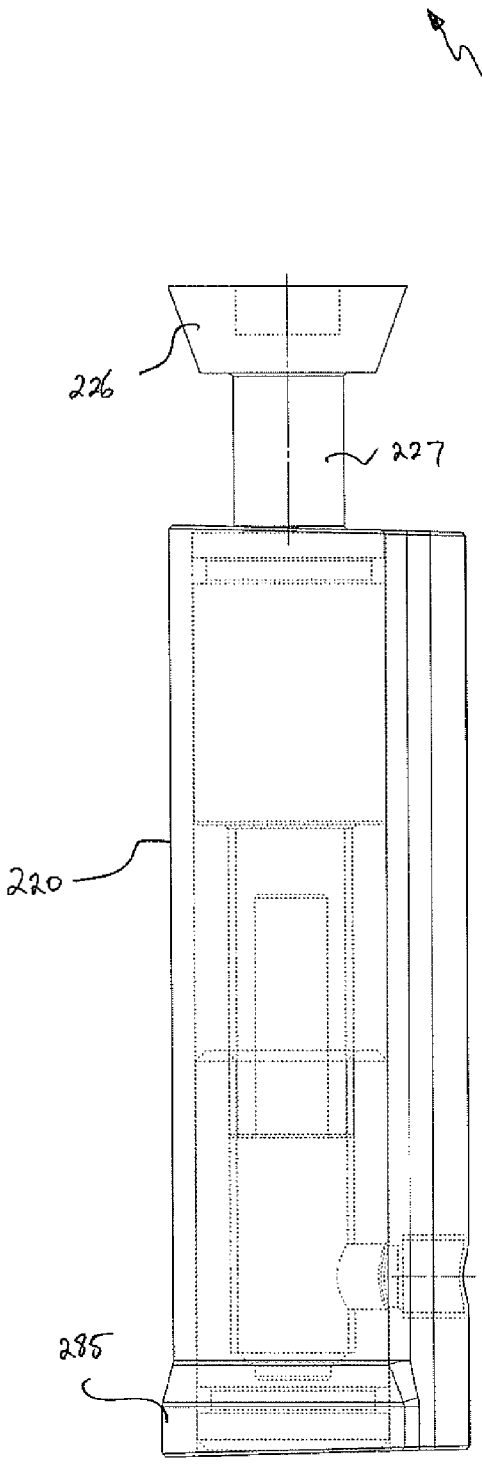
Figure 22:
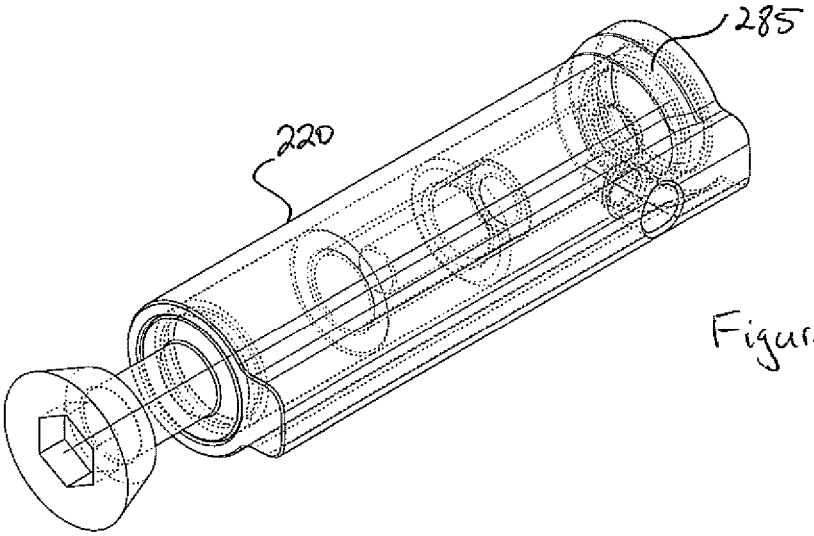
Figure 23:
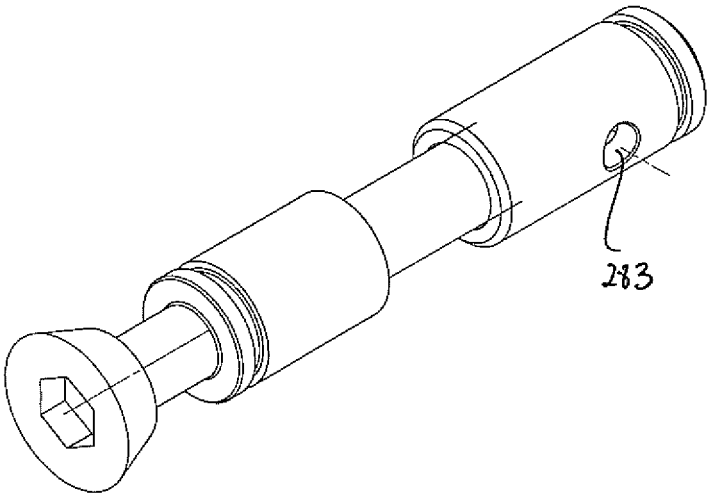
Figure 24:
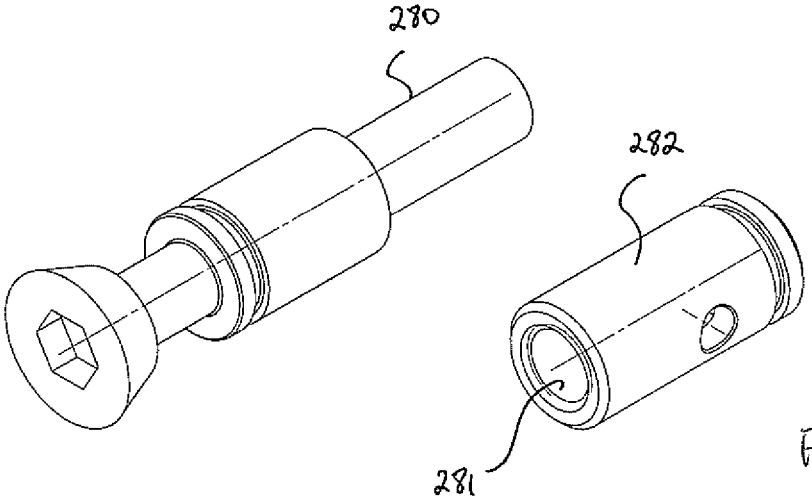

Referring specifically to FIG. 14, the intermediate member 111 is similar to the intermediate member shown in FIG. 1 except for the configuration of the slots 140. One difference is that the engaging surfaces 143 of the intermediate member 111 extend substantially through the inner side surfaces 135, 136 in which the slots are formed. The engaging surface 143 of each slot 140 is engaged by the engaging surface 125 of one of the lock head portions 126 when the lock is adjusted towards its retracted configuration. This broader engaging surface 143 as compared to the engaging surface 43 of the intermediate member 11 shown in FIG. 1 provides a broader contact area for engagement of the lock head portion 126 with the intermediate member 111. Curved transition segments 160 are provided between the engaging surface 143 of each slot 140 and the inner and outer surfaces of the respective inner side surfaces 135,136.

The slots 140 of the intermediate member 111 as compared to the slots 40 of the intermediate member 11 are also different in that the clearing portion 142 of the slots open through the outer side surface of the intermediate member's body. Each clearing portion 142 also increases in height from the lips 146,147 towards the outer side surface of the body so as to enable the clearing portion to clear the correspondingly shaped locked head portions 126 without detrimentally reducing the surface area of the engaging surface 143 of the slots 140. This open configuration of the clearing portion 142 reduces the likelihood of the intermediate member jamming on the lock 112 when the intermediate member is being coupled to the adapter.

Referring to FIGS. 15 to 19, a lock 112 according to another embodiment of the invention is shown. The lock 112 is configured for mounting to the intermediate member 111 shown in FIG. 14 due to the wider head portions 126 at the ends of each arm 127. The lock 112 comprises first and second arms 127A and 127B. The first arm 127A has a threaded male portion 170 which is shaped to be received in a threaded female portion 171 of the second arm 127B. The male and female portions 170,171 are located at respective opposite ends of the arms 127A, 127B to the head portions 126. It is to be understood that the male and female portions could be arranged oppositely such that the first arm comprises a female threaded portion and the second arm comprises a male threaded portion. Although not shown in the drawings, a spring is positioned between the two threaded portions 170, 171 to ensure that the engagement between the portions remains tight.

A groove 172 is provided in the second arm 127B for receiving a stopper (not shown) to stop rotation of the second arm 127B as well as to limit translational movement of the second arm 127B in and out of the body 120 by the length of the groove 172. The stopper may be in the form of a grub screw inserted through an aperture 173 in the lock body 120. The stopper may be moved into and out of a position where it stops rotation of the second arm 127B as required. By stopping rotation of the second arm 127B, with the stopper received in the groove 172 when the first arm 127A is rotated, the engagement of the threaded male and female portions of the first and second arms causes the second arm 127B to move axially with respect to the lock as the groove 172 slides over the stopper. Accordingly, rotation of the first arm 127A causes both first and second arms to be drawn into or extended out of the lock body 120 depending on the direction of rotation. The lock 112 is thus enabled to self-centre as it is being moved towards its retracted locking configuration.

It is to be understood that features of the intermediate member 111 and the lock 112 shown in FIGS. 14 to 19 could be combined with some of the features of the intermediate member 11 and lock 12 shown in FIGS. 1 to 13.

Referring now to FIGS. 20 to 24, a lock 212 for locking a wear member to in its assembled condition with a digging device according to a further embodiment of the present invention is shown. Similar features of the lock 212 to the locks 12, 112 shown and described in respect of FIGS. 1 to 19 have been designated with the same reference number but prefixed with numeral 2.

A major difference between the lock 212 according to the embodiments shown in FIGS. 20 to 24 and the locks 12, 112 of other embodiments is that the lock 212 has a single locking element in the form of a head portion 226 mounted on the end of a single arm 227, which extends from one end of the lock body 220. The single arm 227 has a threaded male portion 280 which is received in a threaded female portion 281. The threaded female portion 281 may be integrally formed with the lock body 220 or as in the embodiment shown in FIGS. 20 to 24 comprises a separate insert 282 which is inserted into the lock body 220. Although not shown in the drawings, a spring is positioned between the two threaded portions 280, 281 to ensure that the engagement between the portions remains tight. The insert 282 has an indentation 283 for receiving a stopper (not shown), in the form of a grub screw, to prevent rotational and translational movement of the insert with respect to the lock body 220.

At the opposite end of the lock body to the single arm 227 and head portion 226, the lock body 220 has a lip 285 around the outer surface of the lock body. The lip 285 is shaped to engage a chamfer formed in the cavity of the adaptor. The chamfer may be linear or curved. The engagement of the lip 285 with the chamfer together with the engagement of the head portion 226 with an engagement portion of the intermediate member provides a bracing or clamping action to lock the intermediate member and adaptor together.

It is also to be understood that whilst the above description has been made in respect of a three part excavation tooth assembly (adaptor, intermediate member and point), the embodiments of the present invention described above may be incorporated into a two part excavation tooth assembly comprising just an adaptor and a point. The point may have some of the features described above for the intermediate member.

Referring now to FIGS. 25-29, a wear assembly in the form of an excavation tooth assembly according to a further embodiment is shown incorporating a lock 312 having a single locking element as described above with respect to the embodiment shown in FIGS. 20-24. Similar features of the excavation tooth assembly to earlier described assemblies have been given the same reference numeral but prefixed with the numeral 3. The excavation tooth assembly is shown as a two part assembly comprising a point 311 and an adapter 310. But as referred to above, the features of this excavation tooth assembly may be adapted for use in a three part assembly involving an intermediate part disposed between the point and the adapter.

The single locking element of the lock 312 comprises a D-shaped head portion 379 mounted on the end of a single arm 327, which extends from a first end of the lock body 320. The arm 327 has a threaded female portion 381 which is coupled to a threaded male shank portion 380 of an actuator 384 inside the lock body. A spring 385 is located partially inside the first threaded portion 380 and partially inside the second threaded portion 381 so that it extends between the threaded portions and provides a bias to the threaded portions that ensures the engagement between the portions remains tight.

A groove 372 is provided in the arm 327 for receiving a stopper in the form of a grub screw 386 to stop rotation of the arm 327 but allow translation of the arm 327 to the limit of the length of the groove 372. Translational movement of the arm 327 occurs under influence of the actuator 384 when it is rotated. The actuator 384 comprises a head portion 387 at the end of the threaded shank portion 380 which engages an internal ridge 388 in the lock body 320. This prevents translational movement of the actuator 384 further into the lock body 320 but which allows rotational movement of the actuator to actuate the translational movement of the arm 327.

The lock 312 also comprises a retainer in the form of a collar 389 that is located between and engages the inner surface of the lock body 320 and the head portion 387 of the actuator 384. The function of the collar 389 is to retain the actuator 384 inside the lock body 320 and prevent it from slipping out of the end of the lock body at which the retainer is located.The collar 389 is threaded to engage with the threaded inner surface of the lock body 320. Preferably this thread on the collar is a left hand thread to prevent accidental unscrewing when the arm 327 is being moved from its retracted to its extended configuration.

The lock body 320 also comprises a flange 390 located at the lock body's first end from which the arm 327 projects. In use, the inner surface 391 of the flange 390 engages the nose of the adapter 310 and the outer surface 392 of the flange 390 engages an interior surface of the socket of the point 311 mounted to the adapter. This interior surface of the point that is engaged by the lock flange is formed as a recess 399 in the inner surface of the point socket (see FIGS. 25 D and E). The recess 399 enables point to fit with the lock as well as to provide a means for accurately locating the point with respect to the lock and as a result also with the adapter to which the lock is mounted. When the arm 327 is moved into its retracted configuration to lock the point to the adapter, engaging surfaces 325*a,b* of the head portion 379 mounted to the arm engage engaging surfaces 343*a,b* of the point 311. In doing so, a portion of the point 311 is clamped by the head portion 379 on one side and the flange 390 on the other. This strengthens the locking configuration of the lock 312 with the point 311.

Figure 25:
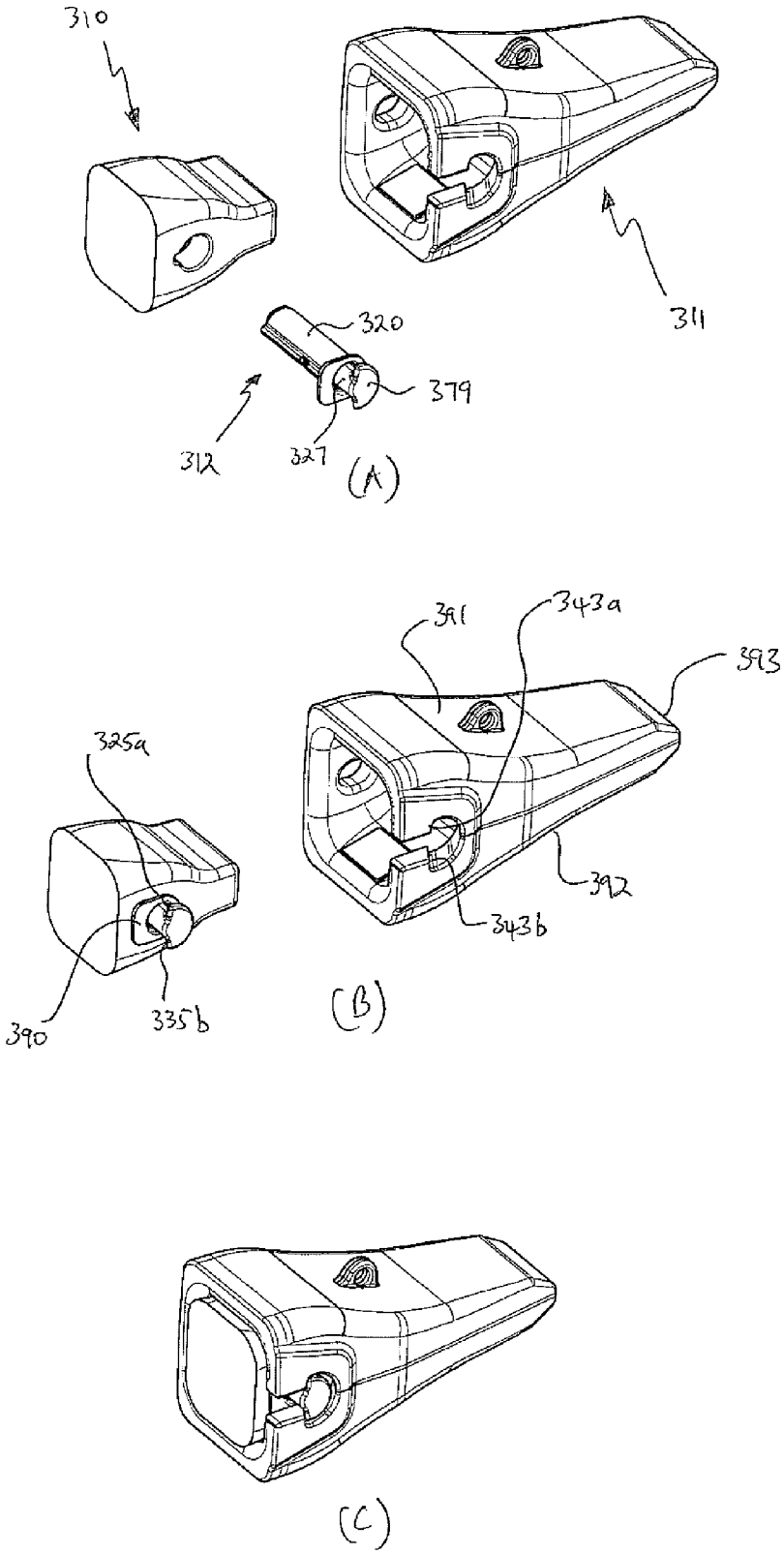
FIGS. 25A-C is a series of perspective views of a wear assembly in the form of an excavation tooth assembly comprising a point, an adapter and a lock according to a further embodiment being assembled.
FIGS. 25D and E are perspective views of the point of FIGS. 25A-C, in FIG. 25E the position of the lock is shown with respect to the point when the point is assembled with and locked to the adapter.
Figure 25D:
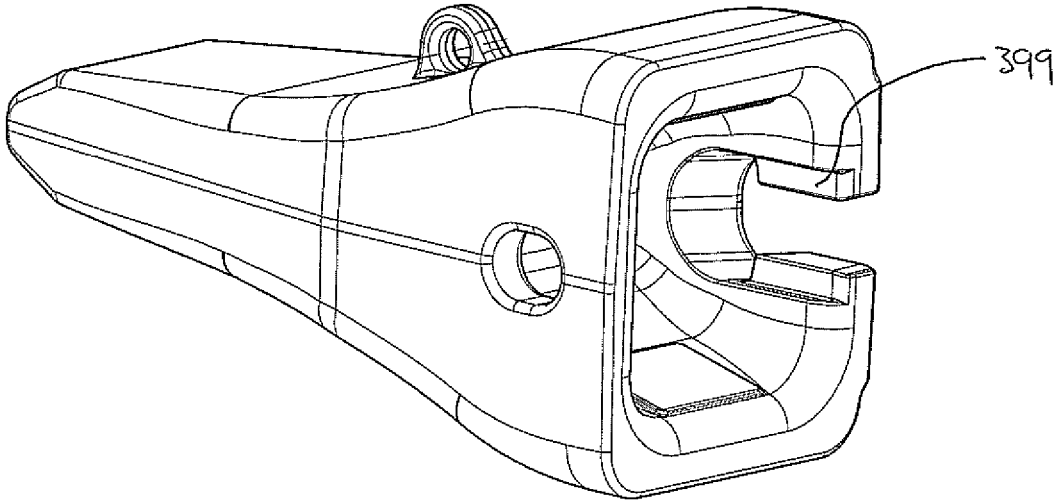
Figure 25E:
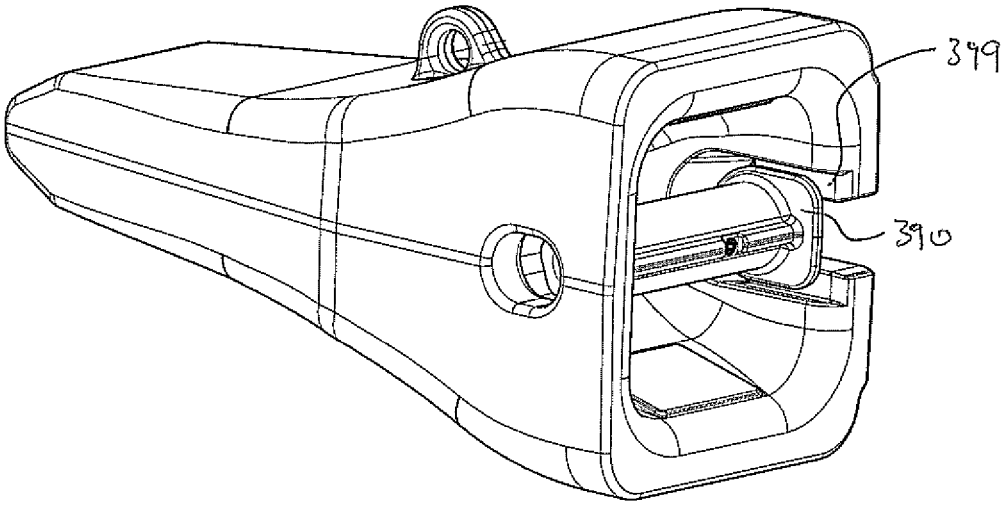
Figure 26:
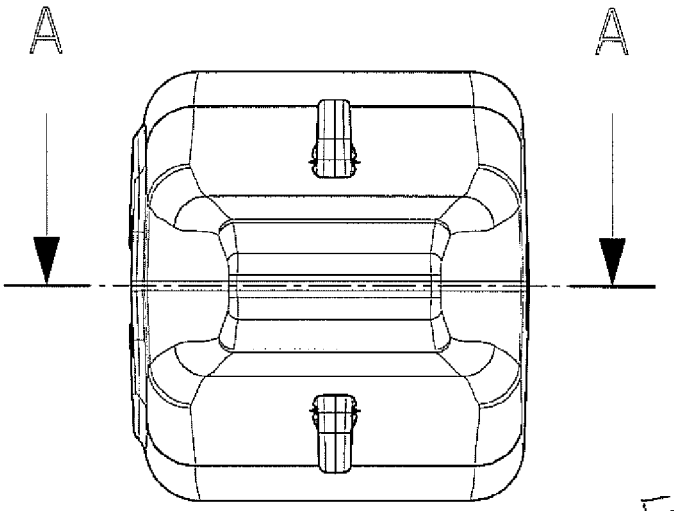
FIG. 26 is a front view of the excavation tooth assembly of FIG. 25.
Figure 27:
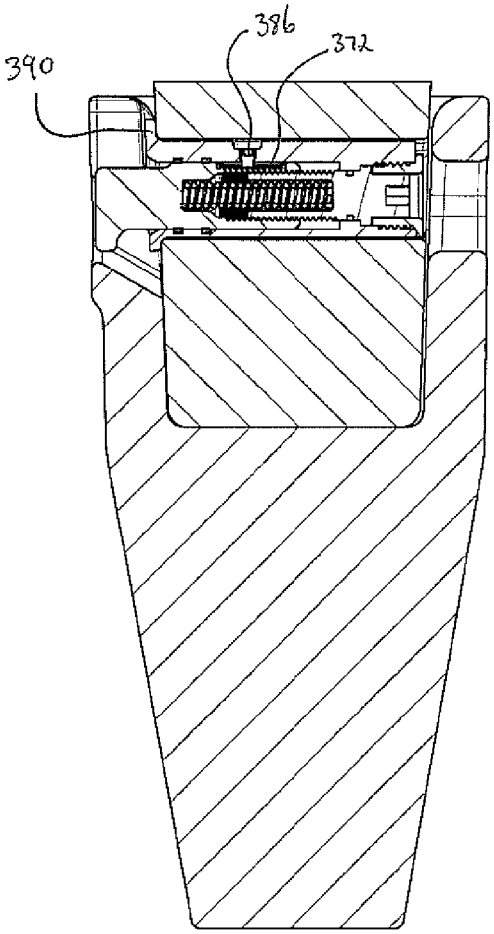
FIG. 27 is a cross-sectional view through A-A of FIG. 26.
Figure 28A:
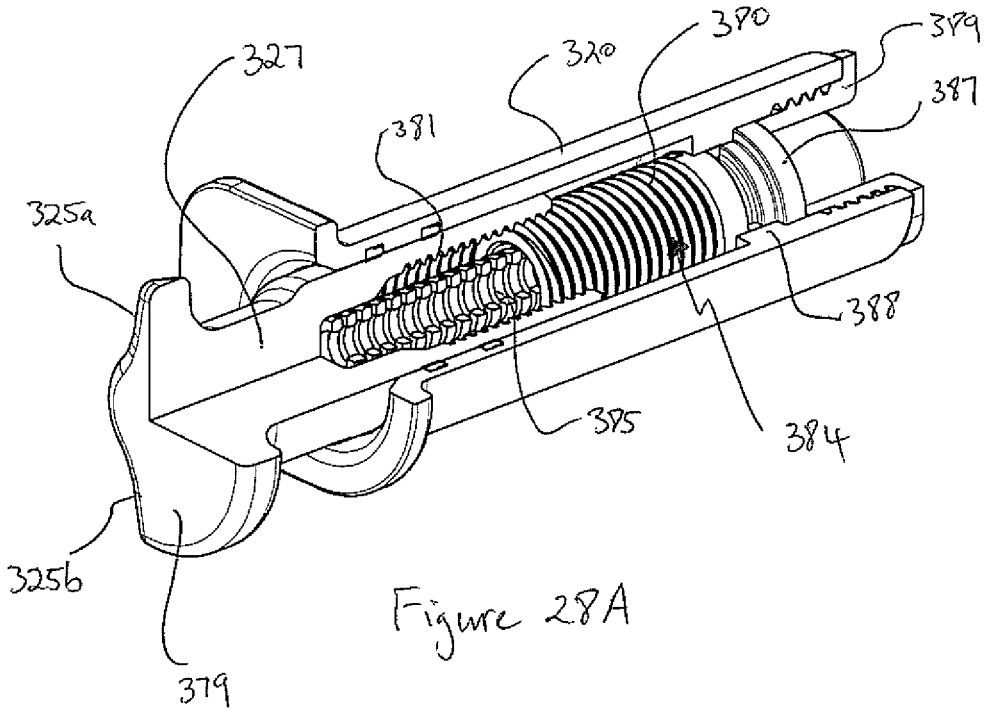
FIGS. 28A and B are cut-away perspective views of the lock of FIG. 25 in its extended and retracted configurations.
Figure 28B:
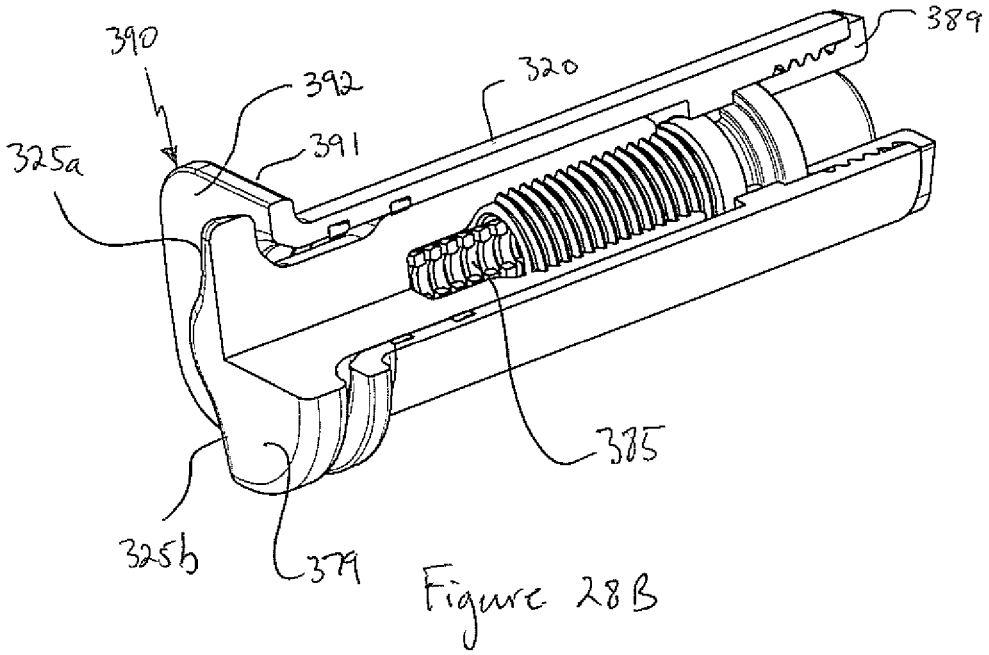
Figure 29:
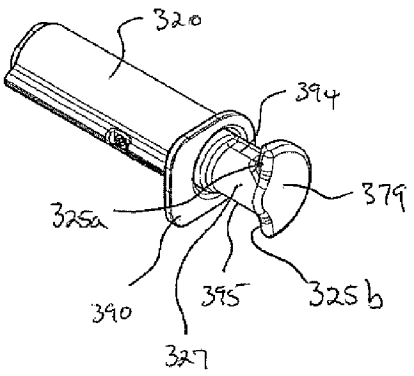
FIG. 29 is top, side, end, perspective and cross-sectional views of the lock of FIG. 25.
Figure 29:
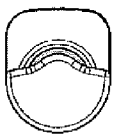
Figure 29:
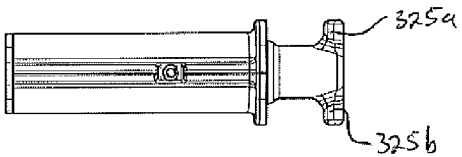
Figure 29:
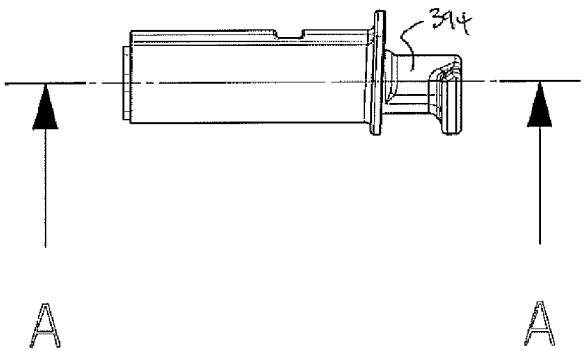
Figure 29:
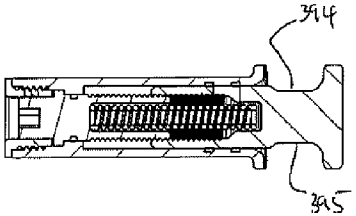
Figure 29:
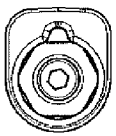
Figure 30:
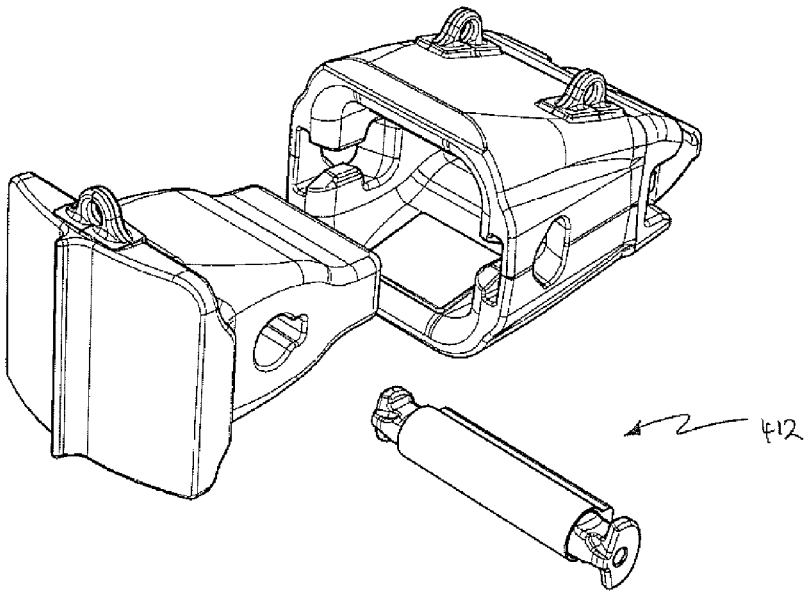
FIG. 30A-C is a series of perspective views of a wear assembly in the form of an excavation tooth assembly comprising an intermediate member, an adapter and a lock according to a further embodiment being assembled.
Figure 30:
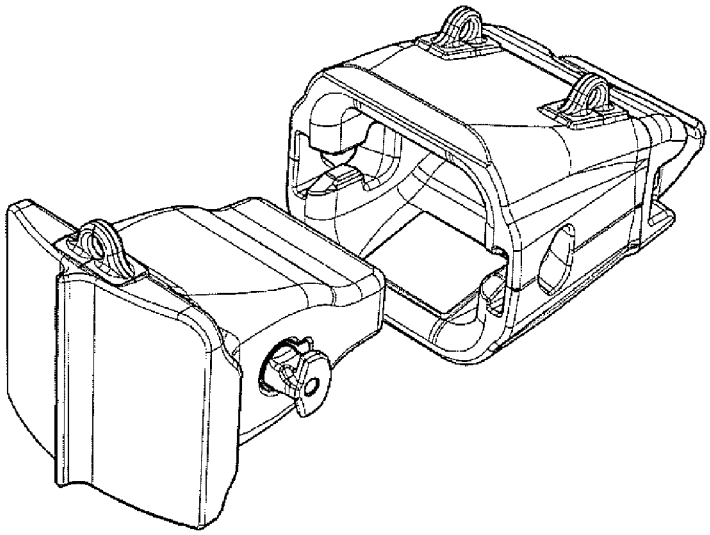
Figure 30:
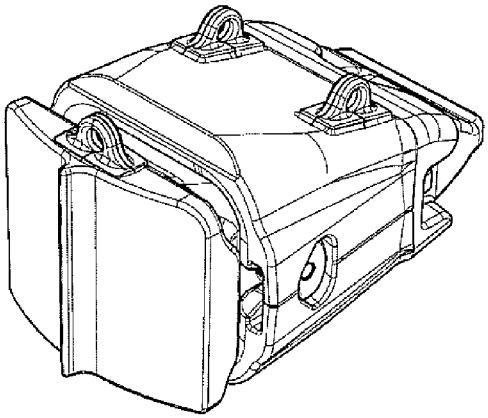
Figure 31:
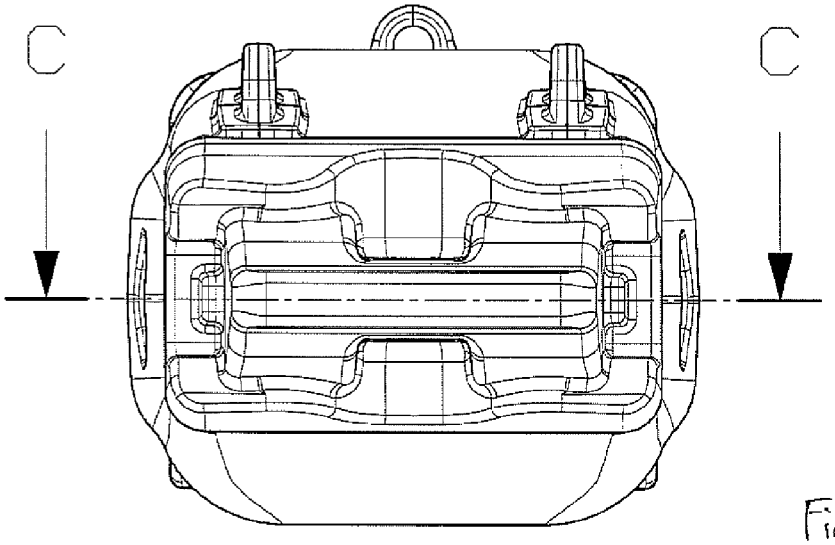
FIG. 31 is a front view of the excavation tooth assembly of FIG. 30.
Figure 32:
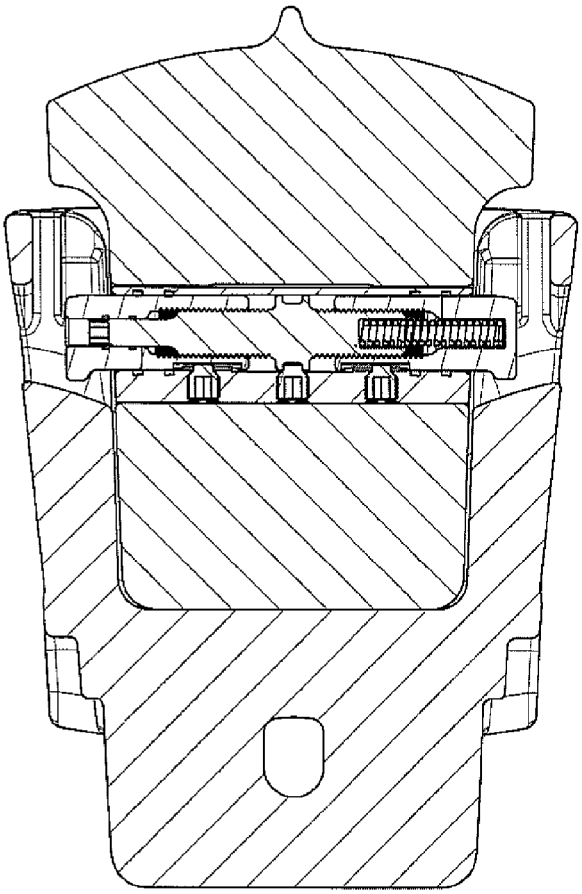
FIG. 32 is a cross-sectional view through C-C of FIG. 31.
Figure 33:
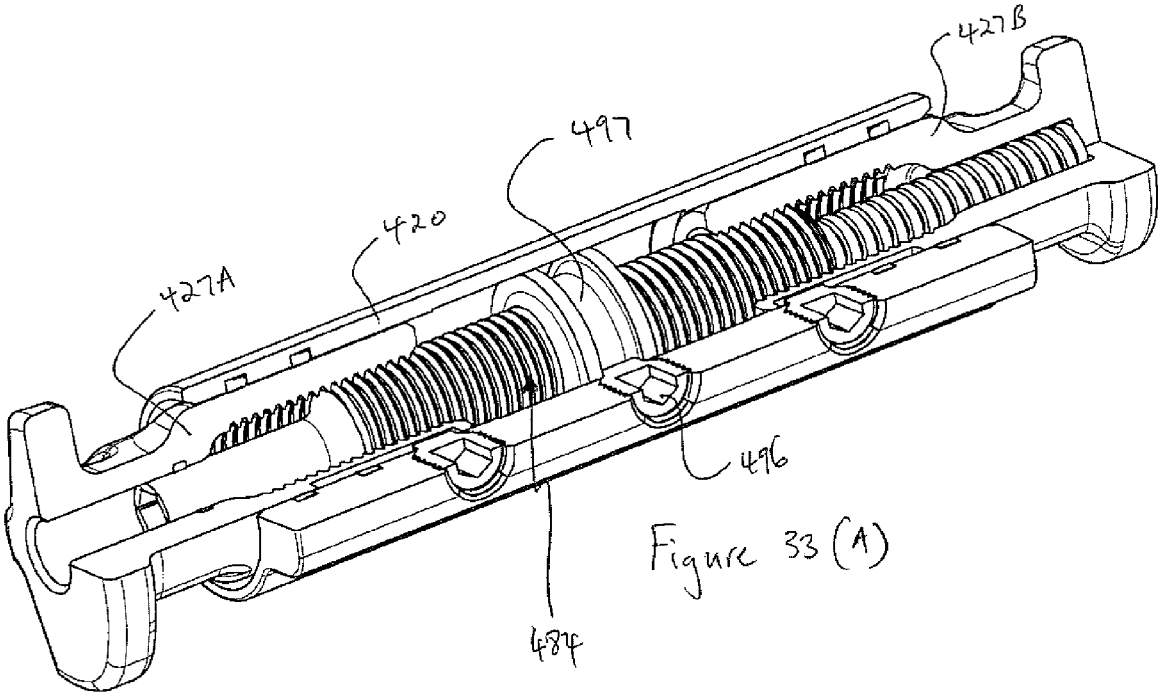
FIGS. 33A and B are cut-away perspective views of the lock of FIG. 30 in its extended and retracted configurations.
Figure 33:
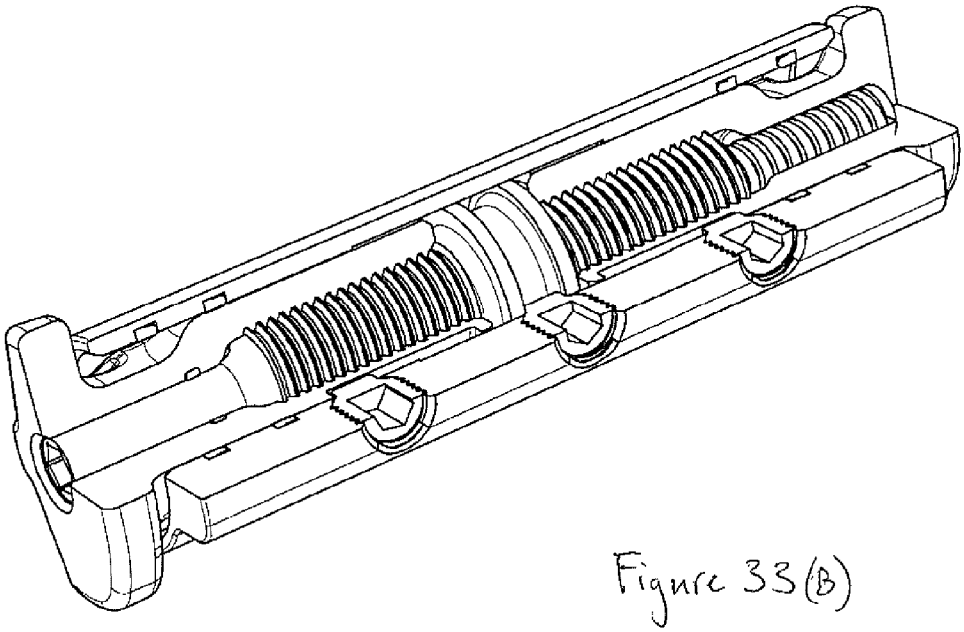
Figure 34:
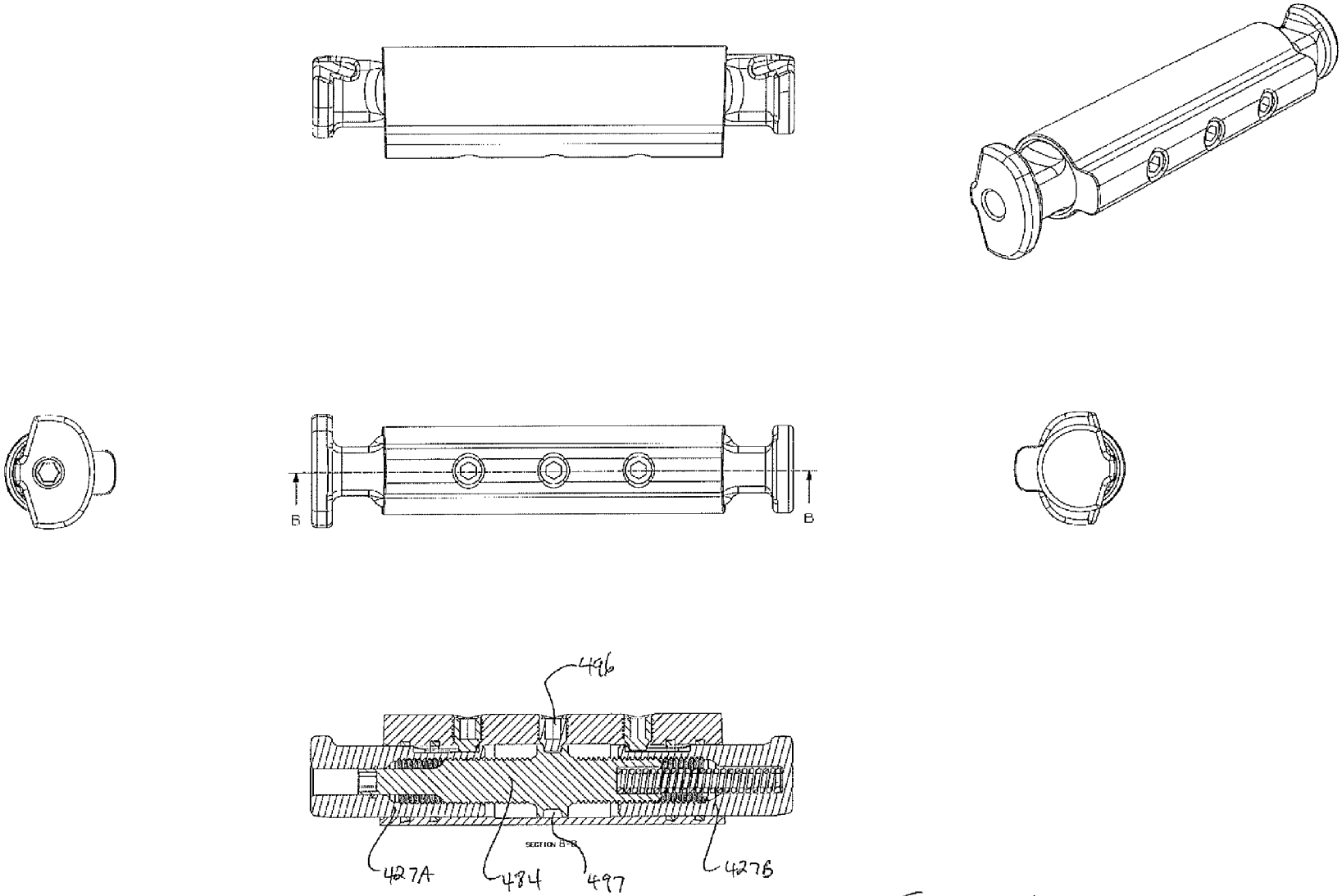
FIG. 34 is top, side, end, perspective and cross-sectional views of the lock of FIG. 30.

Referring in particular to FIG. 25, the engaging surfaces 325*a,b* and 343*a,b* of the lock 312 and the point 311 respectively are shaped with the taper as described above with other embodiments to allow for tightening of the locking engagement after the parts have been worn. The engaging surfaces 325, 343 also extend transversely to the longitudinal axis of the point 311 along which the top and bottom surfaces 391, 392 of the point convergingly extend towards a digging end 393. This allows the engaging surfaces 325, 343 to slip with respect to one another without breaking engagement when vertical transverse loads, in use, are placed on the point. As a result, the point 311 is allowed to rock up and down with respect to the adaptor 310. This minimizes loading on the lock 312 and as result reduces the likelihood of the lock being broken in use.

The lock has first and second (upper and lower) engaging surfaces 325*a*, 325*b* which extend in divergent directions, that is they are obtusely angled (but at less than 180°) with respect to one another. The point has similar first and second (upper and lower) engaging surfaces 343*a*, 343*b*. This allows the slip to occur on both upward and downward loads on the digging end of the point 311.

To further facilitate this rocking motion and minimise loading on the lock 312, the arm 327 is shaped with upper and lower recesses that define generally parallel flat surface portions 394, 395 in the generally cylindrical arm. The flat surface portions 394, 395 ensure that the top and bottom surfaces of the arm 327 are spaced from engagement with the point 311 so that there is clearance to enable the point 311 to rock up and down without bearing on the arm. Although shown as generally flat surfaces, they could be curved provided that there was clearance for the point to move in this rocking motion in use.

The flat surface portions 394, 394 extend between the head portion 379 at one of the arm 327 to the first end of the lock body 320 when the lock is in its extended configuration and partially project beyond the lock body when the lock is in its retracted configuration.

Referring now to FIGS. 30-34, a wear assembly in the form of an excavation tooth assembly according to another embodiment is shown which has similar features to the excavation tooth assembly described in respect of FIGS. 25-29 but incorporates a lock 412 having two locking elements and three tooth member parts (adapter, intermediate member and point). Although of course it is to be understood that the embodiment shown in FIGS. 30-34 could be adapted for a two-part assembly. Similar features of the excavation tooth assembly in FIGS. 30-34 to earlier described assemblies have been given the same reference numeral but prefixed with the numeral 4.

The lock 412 comprises an actuator 484 housed inside the lock body 420 couples to the arms 427A, 427B of both locking elements of the lock. A stopper in the form of a grub screw 496 received in a circumferential groove 497 of the actuator 484 allows the actuator to be rotated but prevents translation of the actuator. Threaded shank portions of the actuator 484 couple to respective threaded portions of the arms 427A, 427B which are prevented from rotating (but allowed to translate) by a groove and stopper arrangement similar to those described in respect of embodiments above. Accordingly rotation of the actuator 484 results in translation of both of the arms 427A, 427B generally at the same rate of translation for each arm.

It is to be understood that, unless indicated otherwise by express language or necessary implication, the tooth members or locking members according to any embodiment of one aspect of the present invention may further encompasses any one or combination of features described above in relation to embodiments of other aspects of the present invention.

Although the above description has been made in respect of excavation tooth assemblies, it is to be understood that features of these teeth assemblies could be applied to other types of wear assemblies including shroud assemblies that include a shroud mounted to the digging edge of a digging device to protect that edge from wear.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A wear assembly comprising:

a first wear member including a socket;

a second wear member including a nose portion, the wear members arranged in an assembled condition where the nose portion of the second wear member is received within the socket of the first wear member; and a lock mounted to the second wear member, the lock adjustable between an extended configuration and a retracted configuration, the lock comprising at least one locking element that projects outwardly from the second wear member in the extended configuration of the lock and is operative to be displaced inwardly from the extended configuration towards the second wear member to adopt the retracted configuration of the lock; wherein, with the first and second wear members in the assembled condition, movement of the at least one locking element from the extended configuration towards the retracted configuration causes the second wear member to be locked to the first wear member in the assembled condition, and wherein the first wear member has an inner surface that defines said socket, and at least one slot that extends along said inner surface and configured to provide clearance for the at least one locking element to allow the second wear member to move relative to the first wear member into the assembled condition whilst the lock is in its extended configuration.

2. A wear assembly according to claim 1, wherein the first wear member has an engaging surface which defines a portion of the at least one slot, the engaging surface being arranged to oppose the at least one locking element when in the assembled condition, and the at least one locking element is caused to move into engagement with the engaging surface on movement of the locking element towards the retracted configuration to lock the first wear member to the second wear member.

3. A wear assembly according to claim 1, wherein the lock further comprises a lock body and the at least one locking element is movably mounted to said lock body.

4. A lock for locking a wear member in an assembled condition with another member, wherein the lock comprises:

a body;

at least one locking element that projects outwardly from the body in the extended configuration of the lock and is operative to be displaced inwardly from the extended configuration towards the body to adopt a retracted configuration of the lock, wherein movement of the at least one locking element from the extended configuration towards the retracted configuration is arranged to cause the wear member to be locked in its assembled condition; and an actuator housed within the body, configured so that the actuator is allowed to rotate but prevented from translating with respect to the body, wherein the actuator is configured to cause inward displacement of the at least one locking element when the actuator is rotated.

5. A lock according to claim 4, wherein the at least one locking element comprises at least one engaging surface for engaging the wear member in its assembled condition with another member.

6. A lock according to claim 4, wherein the at least one locking element comprises two engaging surfaces, each engaging surface being angled with respect to the other engaging surface of that locking element.

7. A lock according to claim 4, wherein the at least one locking element comprises a head portion, side surface portion of the head portion defining an engaging surface for engaging the wear member.

8. A lock according to claim 7, wherein the side surface portion of the head portion is shaped so that the width of the head portion is tapered across its depth.

9. A lock according to claim 7, wherein a cross-sectional area of the head portion at its end surface furthest from the lock body is greater than a cross-sectional area of the head portion at its end surface closest to the lock body.

10. A lock according to claim 7, wherein the at least one locking element comprises an arm to which the head portion is mounted, the arm moveable into and out of the lock body to adjust the lock between its extended and retracted configurations.

11. A lock according to claim 4, wherein the lock comprises at least one tool engagement location where a tool may engage the lock to adjust the lock between its extended and retracted configurations.

12. A lock according to claim 4, wherein the lock comprises two locking elements.

13. A lock according to claim 12, wherein the locking elements each comprise head portions mounted on the ends of arms extending from either side of the lock body, each head portion defining at least one engaging surface for engaging the wear member.

14. A lock according to claim 12, wherein the locking elements are coupled together so that movement of either of the locking elements results in a corresponding movement in the opposite direction of the other of the locking elements.

15. A lock according to claim 14, wherein the locking elements are coupled such that movement of the locking elements occurs at the same rate of movement relative to the lock body.

16. A lock according to claim 14, wherein the locking elements are coupled by the actuator.

17. A lock according to claim 16, wherein the actuator connects at a first end to one locking element and at an opposed second end to the other locking element.

18. A lock according to claim 9, wherein the actuator has a circumferential groove for receiving a first stopper to stop translation but allow rotation of the actuator and wherein the at least one locking element has an elongate groove for receiving a respective second stopper to stop rotation but allow translation of the at least one locking element.

19. A lock according to claim 4, wherein the elongate groove formed in the at least one locking element has a defined length, the elongate groove thereby configured to limit the translational movement of the respective locking element by its defined length when the respective second stopper is received in the elongate groove.

20. A lock according to claim 13, wherein each arm has shaped portions that enable the arm to be spaced from engagement with the wear member when the engaging surface is engaging the wear member.

21. A lock according to claim 20, wherein the shaped portions comprise flat surfaces.

22. A lock according to claim 20, wherein the shaped portions are formed as one or more recesses in each arm.

23. A lock according to claim 20, wherein the shaped portions are provided on opposed sides of each arm.

24. A lock according to claim 4, wherein the lock comprises a first engaging portion which engages a first surface of the wear member when the lock is in its locking configuration and a second engaging portion which engages a second surface of the wear member when the lock is in its locking configuration such that a portion of the wear member is clamped by the first and second engaging portions.

25. A lock according to claim 24, wherein the first engaging portion comprises one of the locking elements and the second engaging portion comprises a flange portion formed on the lock body.

* * * * *